US010711782B2

(12) United States Patent
Choi et al.

(10) Patent No.: US 10,711,782 B2
(45) Date of Patent: Jul. 14, 2020

(54) SCROLL COMPRESSOR WITH WRAP CONTOUR MODIFICATION

(71) Applicant: LG ELECTRONICS INC., Seoul (KR)

(72) Inventors: Jungsun Choi, Seoul (KR); Yongkyu Choi, Seoul (KR); Cheolhwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 303 days.

(21) Appl. No.: 15/817,515

(22) Filed: Nov. 20, 2017

(65) Prior Publication Data

US 2018/0306187 A1 Oct. 25, 2018

(30) Foreign Application Priority Data

Apr. 20, 2017 (KR) ..... 10-2017-0051231
Apr. 24, 2017 (KR) ..... 10-2017-0052516

(51) Int. Cl.
*F04C 18/02* (2006.01)
*F01C 1/02* (2006.01)
(Continued)

(52) U.S. Cl.
CPC ..... *F04C 18/0215* (2013.01); *F04C 18/0284* (2013.01); *F04C 23/008* (2013.01);
(Continued)

(58) Field of Classification Search
CPC ..... F04C 18/0269; F04C 18/0246; F04C 18/0215; F04C 29/0057; F01C 1/0246; F01C 1/0284
See application file for complete search history.

(56) References Cited

U.S. PATENT DOCUMENTS 5,171,141 A * 12/1992 Morozumi ..... F04C 18/0269 418/55.2
2012/0230855 A1 9/2012 Seong et al.
2016/0053759 A1 2/2016 Choi et al.

FOREIGN PATENT DOCUMENTS

CN 102678550 9/2012
CN 203035550 7/2013
(Continued)

OTHER PUBLICATIONS

Chinese Office Action dated May 5, 2019 with English Translation.
(Continued)

*Primary Examiner* — Deming Wan
(74) *Attorney, Agent, or Firm* — Ked & Associates LLP

(57) ABSTRACT

A scroll compressor is provided that may include a first wrap, and a second wrap engaged with the first wrap and coupled to be eccentric to a center of rotation of a rotational shaft to form a compression chamber, moving toward a central portion, together with the first wrap while performing an orbiting motion with respect to the first wrap. A height of at least one of the first wrap or the second wrap may be formed to have at least two inclination machining amounts which decrease toward the central portion, and the inclination machining amount of the central portion may be larger than the inclination machining amount of an edge portion or a wrap rigidity at a specific section, thereby preventing frictional loss or abrasion of the wrap and breakage of the wrap.

20 Claims, 17 Drawing Sheets

(51) Int. Cl.
*F04C 29/00* (2006.01)
*F04C 29/12* (2006.01)
*F04C 23/00* (2006.01)

(52) U.S. Cl.
CPC ..... *F04C 29/0057* (2013.01); *F04C 29/12* (2013.01); *F04C 18/0246* (2013.01); *F04C 18/0276* (2013.01); *F04C 2240/30* (2013.01); *F04C 2240/60* (2013.01)

(56) References Cited

FOREIGN PATENT DOCUMENTS

| | | | | |
|---|---|---|---|---|
| CN | 105370571 | | 3/2016 | |
| CN | 105431634 | | 3/2016 | |
| EP | 2154375 | A1 * | 2/2010 | ..... F04C 18/0269 |
| JP | 2000-257573 | | 9/2000 | |
| JP | 2007-278270 | | 10/2007 | |
| JP | 2012-233421 | | 11/2012 | |
| JP | 5109351 | | 12/2012 | |
| KR | 10-1059880 | | 8/2011 | |
| KR | 10-2016-0022146 | | 2/2016 | |
| KR | 10-2016-0074301 | | 6/2016 | |

OTHER PUBLICATIONS

International Search Report dated Mar. 30, 2018 issued in Application No. PCT/KR2018/003816.

* cited by examiner

SCROLL COMPRESSOR WITH WRAP CONTOUR MODIFICATION

CROSS-REFERENCE TO RELATED APPLICATION(S)

Pursuant to 35 U.S.C. § 119(a), this application claims priority to Korean Application No. 10-2017-0051231, filed in Korea on Apr. 20, 2017, and Korean Application No. 10-2017-0052516, filed in Korea on Apr. 24, 2017, the contents of which are incorporated by reference herein in its entirety.

BACKGROUND

1. Field

A scroll compressor, and more particularly, a scroll compressor capable of preventing frictional loss or abrasion of a wrap is disclosed herein.

2. Background

The scroll compressor is a compressor that forms a compression chamber including a suction chamber, an intermediate pressure chamber, and a discharge chamber between a plurality of scrolls while the plurality of scrolls perform a relative orbiting motion in an engaged state. Such a scroll compressor may obtain a relatively high compression ratio as compared with other types of compressors while smoothly connecting suction, compression, and discharge strokes of a refrigerant, thereby obtaining a stable torque. Therefore, the scroll compressor is widely used for compressing refrigerant in an air conditioner, for example. Recently, a high-efficiency scroll compressor having a lower eccentric load and an operation speed at 180 Hz or higher has been introduced.

In general, a scroll compressor may be divided into a low pressure type in which a suction pipe communicates with an internal space of a casing constituting a low pressure portion, and a high pressure type in which a suction pipe directly communicates with a compression chamber. Accordingly, in the low pressure type, a drive unit s provided in a suction space which is the low pressure portion, whereas in the high pressure type, a drive unit is provided in a discharge space which is the high pressure portion.

Such a scroll compressor may be divided into an upper compression type and a lower compression type according to positions of the drive unit and the compression unit. A compressor in which the compression unit is located above the drive unit is referred to as an upper compression type, and a compressor in which the compression unit is located below the drive unit is referred to as a lower compression type.

In the scroll compressor, as a pressure of the compression chamber normally increases, an orbiting scroll is subjected to a gas force in a direction away from a fixed scroll. As the orbiting scroll then moves away from the fixed scroll, leakage between compression chambers occurs and compression loss increases.

In view of this, the scroll compressor employs a tip seal method in which a sealing member is inserted into an end face of each of a fixed wrap and an orbiting wrap, or a back pressure method in which a back pressure chamber forming an intermediate pressure or discharge pressure is formed on a rear surface of the orbiting scroll or the fixed scroll, and the orbiting scroll or the fixed scroll is pressed to an opposing scroll by the pressure of the back pressure chamber.

In particular, in the back pressure method, a sealing member is provided between the rear surface of the orbiting scroll (or the rear surface of the fixed scroll) and a frame corresponding thereto, such that the back pressure chamber is formed inside or outside the sealing member. In the back pressure method using such a sealing member, an annular groove is formed in one member consulting a thrust face, and an annular sealing member having a rectangular cross section is inserted into the annular groove. When the compressor is operated, a refrigerant of an intermediate pressure, compressed in the compression chamber, is introduced into the annular groove, and the sealing member is lifted by the intermediate pressure to be brought into close contact with an opposite member, so as to form the back pressure chamber.

However, in the related art scroll compressor as described above, back pressure applied to a central portion of the orbiting scroll becomes larger than back pressure applied to an edge portion of the orbing scroll, and thereby the central portion of the orbiting scroll is excessively pressed toward the fixed scroll. Then, a portion of the fixed wrap, adjacent to a discharge end, may excessively adhere to the orbiting scroll or a portion of the fixed wrap, adjacent to a discharge end, may excessively adhere to the fixed scroll. At the same time, the central portion of the fixed wrap or orbiting wrap is deformed while being bent outward due to a gas force and a centrifugal force applied in a direction of the edge portion, and thereby, frictional loss or abrasion may occur between the fixed wrap or the orbiting wrap and the scroll facing the same, causing a deterioration in compressor efficiency.

In the related art scroll compressor, in a case of a so-called shaft through scroll compressor in which a rotational shaft overlaps the compression chamber in a radial direction, as the rotational shaft is inserted through a central portion of the fixed scroll, a discharge end of the fixed wrap does not sufficiently extend up to the central portion of the fixed scroll due to the rotational shaft, and thereby, rigidity of the discharge end of the fixed wrap is weakened. Accordingly, the fixed wrap may be severely bent or the discharge end of the fixed wrap may be broken. Further, as disclosed in Korean Patent No. 10-1059880, which is hereby incorporated by reference, when a compression ratio of the compression chamber is increased by changing the fixed wrap and the orbiting wrap to an atypical shape, the discharge end of the fixed wrap may be further severely deformed and damaged. In addition, even when a protrusion is formed on the discharge and of the fixed wrap to increase a wrap supporting force, wrap deformation due to the increase in the compression ratio may not be completely suppressed, and thereby reliability of the compressor may be lowered due to frictional loss or abrasion or a wrap fracture.

In the related art scroll compressor, the deformation and fracture of the wrap (particularly, the fixed wrap) are suppressed by changing the shape of the wrap, as disclosed in Japanese Laid-Open Patent Publication No. 2000-257573, which is hereby incorporated by reference. However, in a case where roots of the wrap are made thick, the same groove should be formed on an end of the wrap of the opposite scroll, the wrap fabricating process becomes complicated, and a wrap thickness from a middle of the wrap to an end of the wrap is made thin. Accordingly, there is a limit in that the problem of deformation or fracture of the wrap cannot be solved.

Also, in view of this, when the wrap thickness is made thick as a whole, a size of the compressor is increased due to an increase in a size of the scroll for ensuring an orbiting radius, or a volume of the compression chamber is decreased due to a decrease of the orbiting radius. This may be seen as a result of arbitrarily changing the wrap shape without considering rigidity of the wrap.

BRIEF DESCRIPTION OF THE DRAWINGS

Embodiments will be described in detail with reference to the following drawings in which like reference numerals refer to like elements, and wherein.

DETAILED DESCRIPTION

Description will now be given in detail of a scroll compressor according to exemplary embodiments disclosed herein, with reference to the accompanying drawings. Hereinafter, for the sake of explanation, description will be given of a type of scroll compressor in which a rotational shaft overlaps an orbiting wrap on a same plane in a lower compression-type scroll compressor having a compression unit located lower than a drive unit or drive. This type of scroll compressor is known to be suitable for application to a refrigeration cycle under high temperature and high compression ratio conditions, for example.

Figure 1:
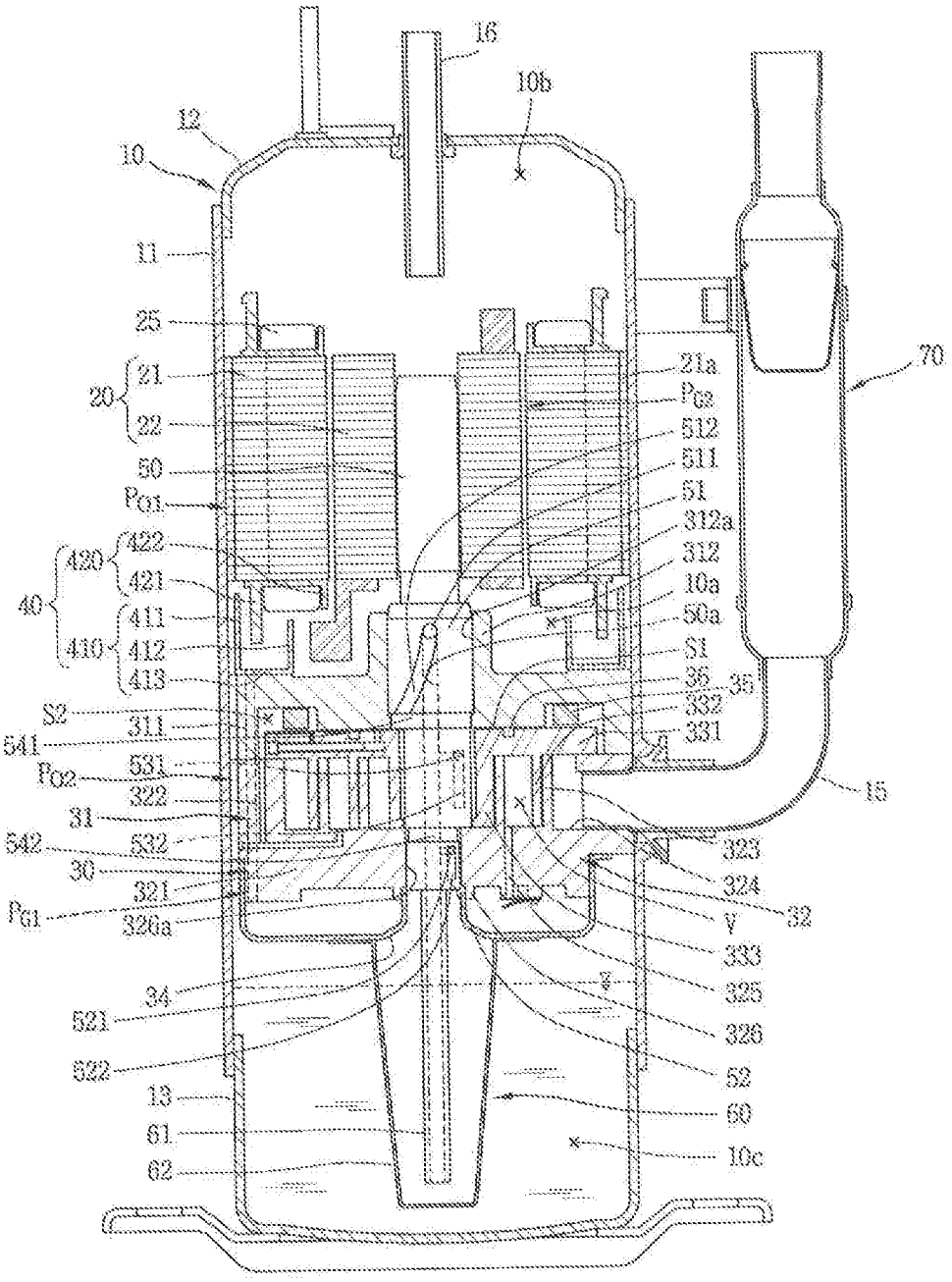
FIG. 1 is a longitudinal sectional view of a lower compression-type scroll compressor in accordance with an embodiment.
Figure 2:
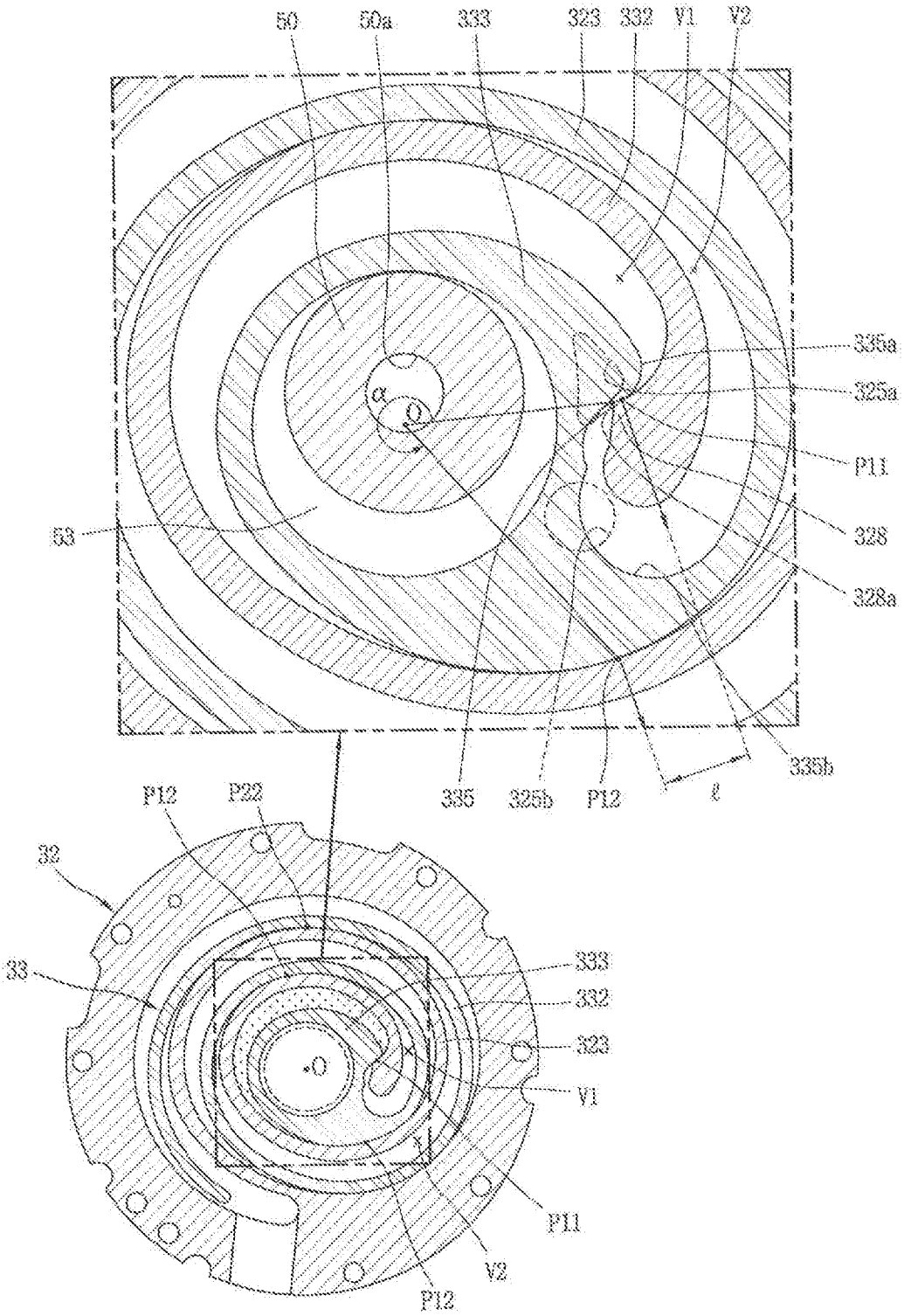
FIG. 2 is a horizontal sectional view of a compression unit in FIG. 1.
Figure 3:
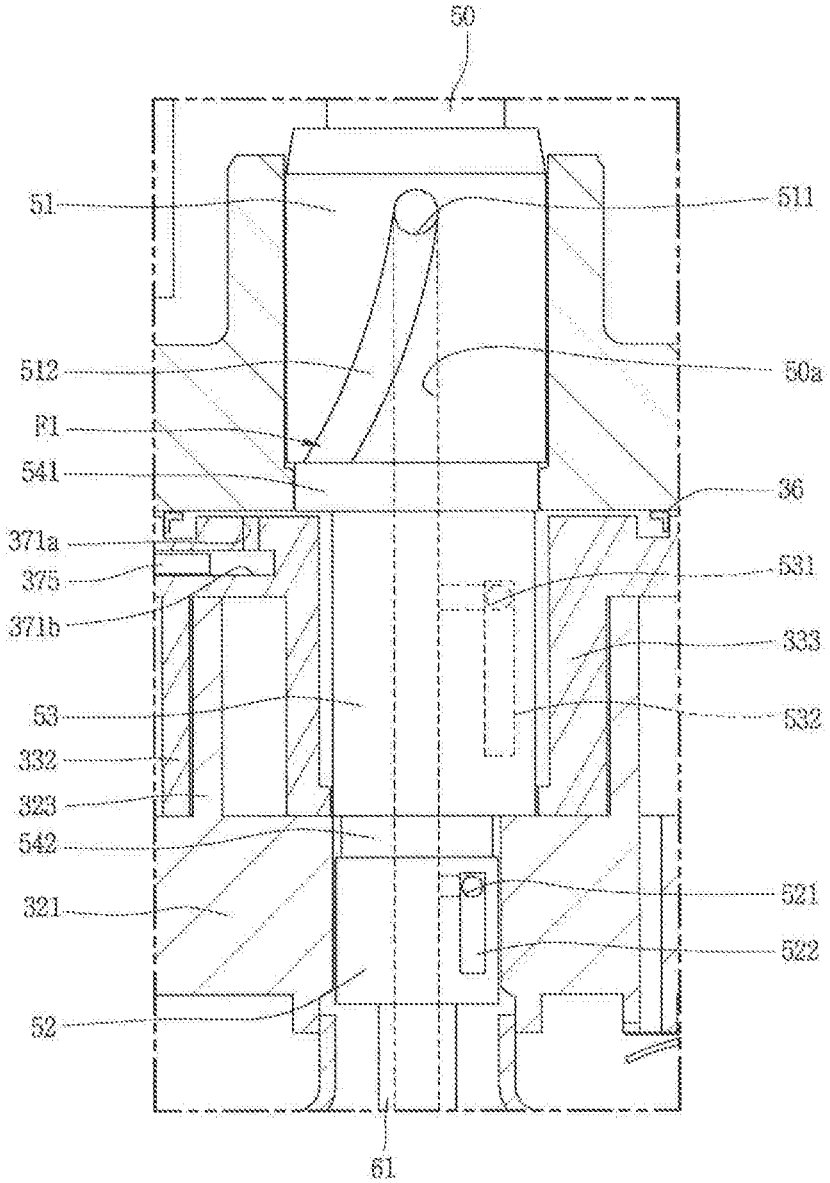
FIG. 3 is a front view illustrating a portion of a rotational shaft for explaining a sliding portion in FIG. 1.
Figure 4:
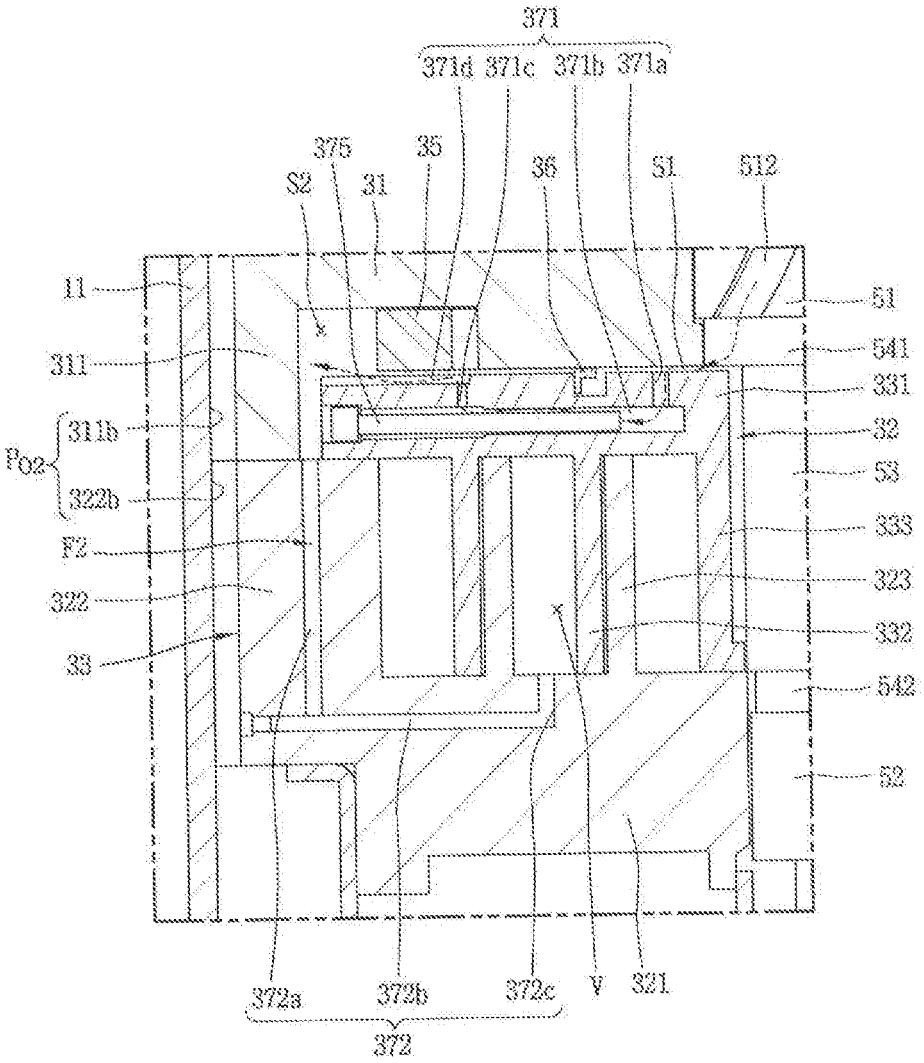
FIG. 4 is a longitudinal sectional view illustrating an oil supply passage (oil feeding path) between a back pressure chamber and a compression chamber in FIG. 1.

FIG. 1 is a longitudinal sectional view of a lower compression-type scroll compressor in accordance with an embodiment, FIG. 2 is a horizontal sectional view of a compression unit of FIG. 1. FIG. 3 is a front view illustrating a portion of a rotational shaft for illustrating a sliding portion in FIG. 1. FIG. 4 is a longitudinal sectional view illustrating an oil supply passage (oil feeding path) between a back pressure chamber and a compression chamber in FIG. 1.

Referring to FIG 1, a lower compression type scroll compressor according to an embodiment may be provided with a motor unit or motor 20 having a drive motor within a casing 10 to generate a rotational force, and a compression unit 30 located below the motor unit 20 and having a predetermined space (hereinafter, referred to as an "intermediate space") 10*a* to compress refrigerant by receiving the rotational force of the motor unit 20. The casing 10 may include a cylindrical shell 11 forming a hermetic container, an upper shell 12 forming the hermetic container by covering an upper portion of the cylindrical shell 11, and a lower shell 13 forming the hermetic container by covering a lower portion of the cylindrical shell 11 and simultaneously forming an oil storage space 10*c*.

A refrigerant suction pipe 15 may directly communicate with a suction chamber of the compression unit 30 through a lateral surface of the cylindrical shell 11, and a refrigerant discharge pipe 16 that communicates with an upper space 10*b* of the casing 10 may be provided through a top of the upper shell 12. The refrigerant discharge pipe 16 may correspond to a path through which compressed refrigerant discharged from the compression unit 30 to the upper space 10*b* of the casing 10 is discharged to outside. The refrigerant discharge pipe 16 may be inserted up to a middle of the upper space 10*b* of the casing 10 to allow the upper space 10*b* to form a kind of oil separation space. Further, according to circumstances, an oil separator (not shown) that separates oil mixed with refrigerant may be connected to the refrigerant suction pipe 15 within the casing 10 including the upper space 10*b* or within the upper space 10*b*.

The motor unit 20 may include a stator 21, and a rotor 22 that rotates within the stator 21. The stator 21 may be provided with teeth and slots forming a plurality of coil winding portions (not shown) on an inner circumferential surface thereof along a circumferential direction, such that a coil 25 may be wound therearound. A second refrigerant passage $P_{G2}$ may be formed by combining a gap between the inner circumferential surface of the stator 21 and an outer circumferential surface of the rotor 22 with the coil winding portions. As a result, refrigerant discharged into the intermediate space 10*a* between the motor unit 20 and the compression unit 30 through a first refrigerant passage $P_{G1}$ which will be described hereinafter, may flow to the upper space 10*b* formed above the motor unit 20 through the second refrigerant passage $P_{G2}$ formed in the motor unit 20.

A plurality of D-cut faces 21*a* may be formed on an outer circumferential surface of the stator 21 along the circumferential direction. The plurality of D-cut faces 21*a* may form a first oil passage $P_{G1}$ together with an inner circumferential surface of the cylindrical shell 11 to allow a flow of oil therethrough. As a result, oil separated from refrigerant in the upper space 10*b* may flow to the lower space 10*c* through the first oil passage $P_{O1}$ and a second oil passage $P_{O2}$, which will be described hereinafter.

A frame 31 forming the compression unit 30 may be fixedly coupled to an inner circumferential surface of the casing 10 with a predetermined interval below the stator 21. An outer circumferential surface of the frame 31 may be, for example, shrink-fitted to or fixedly welded on an inner circumferential surface of the cylindrical shell 11.

A frame sidewall portion or sidewall (hereinafter, referred to as "first sidewall portion" or "first sidewall") 311 in an annular shape may be formed at an edge of the frame 31, and a plurality of communication grooves 311*b* may be formed on an outer circumferential surface of the first sidewall portion 311 along a circumferential direction. The communication grooves 311*b* may form a second oil passage $P_{O2}$ together with a communication groove 322*b* of a first or fixed scroll 32, which will be described hereinafter.

In addition, a first bearing 312 that supports a main bearing 51 of a rotational shaft 50, which will be described hereinafter, may be formed in a center of the frame 31, and a first bearing hole 312*a* may be formed through the first bearing 312 in an axial direction such that the main hearing 51 of the rotational shaft 50 may be rotatably inserted and supported in a radial direction.

The fixed scroll (hereinafter, referred to as a "first scroll") 32 may be provided at a lower surface of the frame 31 with interposed therebetween an orbiting scroll (hereinafter, referred to as a "second scroll") 33, which may be eccentrically connected to the rotational shaft 50. The first scroll 32 may be fixedly coupled to the frame 31, but may also be movably coupled to the frame 31 in the axial direction.

The first scroll 32 may be provided with a fixed disk portion or disk (hereinafter, referred to as a "first disk portion" or "first disk") 321 formed in a substantially disk shape, and a scroll sidewall portion or sidewall (hereinafter, referred to as a "second sidewall portion" or "second sidewall") 322 formed at an edge of the first disk portion 321 and coupled to a lower edge of the frame 31.

A suction port 324 through which the refrigerant suction pipe 15 and a suction chamber may communicate with each other may be formed through one side (or portion) of the second sidewall portion 322, and a discharge port 325 which may communicate with a discharge chamber and through which compressed refrigerant may be discharged may be formed through a central portion of the first disk portion 321. The discharge port 323 (325*a*, 325*b*) may be provided as one in number so as to communicate with both of a first compression chamber V1 and a second compression chamber V2, which will be described hereinafter, but may also be provided in plurality to independently communicate with the compression chambers V1 and V2.

The communication groove 322*b* may be formed on an outer circumferential surface of the second sidewall portion 322, and form the second oil passage $P_{O2}$ to guide collected oil to the lower space 10*c*, together with the communication grooves 311*b* of the first sidewall portion 311.

A discharge cover 34 that guides refrigerant discharged from the compression chamber V (V1, V2) to a refrigerant passage, which will be described hereinafter, may be coupled to a lower side of the first scroll 32. An inner space of the discharge cover 34 may receive the first discharge port 325*a* and the second discharge port 325*b* and simultaneously receive an inlet of the first refrigerant passage $P_{G1}$ to guide refrigerants discharged from the compression chamber V through the discharge ports 325*a* and 325*b* to the upper space 10*b* of the casing 10, more particularly, a space between the motor unit 20 and the compression unit 30.

The first refrigerant passage $P_{G1}$ may be formed sequentially through the second sidewall portion 322 of the fixed scroll 32 and the first sidewall portion 311 of the frame 31 from an inside of a passage separation unit or separator 40, namely, from a side of the rotational shaft 50, which is located at an inside based on the passage separation unit 40. As a result, the second oil passage $P_{O2}$ is formed at an outside of the passage separation unit 40 to communicate with the first oil passage $P_{O1}$.

Further, a fixed wrap (hereinafter, referred to as a "first wrap") 323 forming the compression chamber V in engagement with an orbiting wrap (hereinafter, referred to as a "second wrap") 332, which will be described hereinafter, may be formed on an upper surface of the first disk portion 321. The first wrap 323 will be described hereinafter together with the second wrap 332.

A second bearing 326 that supports a sub-bearing 52 of the rotational shaft 50, which will be described hereinafter, may be formed in the center of the first disk portion 321, and a second bearing hole 326*a* may be formed through the second bearing 326 in an axial direction to support the sub-bearing 52 in a radial direction.

On the other hand, the second scroll 33 may be provided with an orbiting disk portion or disk (hereinafter, referred to as "second disk portion" or "second disk") 331 formed in a substantially disk shape. The second wrap 332 forming the compression chamber V in engagement with the first wrap 331 may be formed on a lower surface of the second disk portion 331.

The second wrap 332 may be formed in an involute shape together with the first wrap 323, but may also be formed in various other shapes realized by connecting a plurality of curved lines. For example, as illustrated in FIG. 2, the second wrap 332 may have a shape in which a plurality of arcs having different diameters and origins are connected, and an outermost curve may be formed in a substantially elliptical shape having a major axis and a minor axis. The first wrap 323 may be formed in a similar manner.

A rotational shaft coupling portion 333 which forms an inner end portion or end of the second wrap 332 and to which an eccentric portion 53 of the rotational shaft 50 to be described hereinafter is rotatably inserted may be formed through a central portion of the second desk portion 331 in an axial direction. An outer circumferential portion of the rotational shaft coupling portion 333 is connected to the second wrap 332 to form the compression chamber V together with the first wrap 322 during a compression process.

The rotational shaft coupling portion 333 may be formed at a height overlapping with the second wrap 332 on a same plane, and thus, the eccentric portion 53 of the rotational shaft 50 may be formed at a height overlapping with the second wrap 332 on the same plane. Accordingly, a repulsive force and a compressive force of refrigerant offset each other while being applied to the same plane based on the second disk portion 331, thereby preventing an inclination of the second scroll 33 due to an action of the compressive force and repulsive force.

In addition, the rotational shaft coupling portion 333 may be provided with a concave portion 335 formed on an outer circumferential portion facing an inner end portion of the first wrap 323 and engaged with a protruding portion or protrusion 326 of the first wrap 323, which will be described hereinafter. At one side of the concave portion 335, an increasing portion 335*a* may be formed on an upstream side along a forming direction of the compression chamber V to increase a thickness from an inner circumferential portion to an outer circumferential portion of the rotational shaft coupling portion 333. This may extend a compression path of the first compression chamber V1 immediately before discharge, and consequently a compression ratio of the first compression chamber V1 may be increased close to a pressure ratio of the second compression chamber V2. The first compression chamber V1 may be a compression chamber formed between an inner surface of the first wrap 323 and an outer surface of the second wrap 332, and will be described hereinafter separately from the second compression chamber V2.

At another side of the concave portion 335 an arcuate compression surface 335*b* having an arcuate shape may be formed. A diameter of the arcuate compression surface 335*b* is decided by a thickness of the inner end portion or end of the first wrap 323, that is, a thickness of the discharge end, and an orbiting radius of the second wrap 332. When the thickness of the inner end portion of the first wrap 323 increases, a diameter of the arcuate compression surface 335*b* increases. As a result, a thickness of the second wrap 332 around the arcuate compression surface 333*b* may increase to ensure durability, and the compression path may extend to increase the compression ratio of the second compression chamber V2 to that extent.

The protruding portion 326 that protrudes toward the outer circumferential portion of the rotational shaft coupling portion 333 may be formed adjacent to an inner end portion or end (a suction end or starting end) of the first wrap 323 corresponding to the rotational shaft coupling portion 333. The protruding portion 326 may be provided with a contact portion 326*a* that protrudes therefrom and is engaged with the concave portion 335. In other words, the inner end portion of the first wrap 323 may be formed to have a larger thickness than other portions. As a result, a wrap strength at the inner end portion of the first wrap 323, which is subjected to the highest compressive force on the first wrap 323, may increase so as to enhance durability.

The compression chamber V may be formed between the first disk portion 321 and the first wrap 323, and between the second wrap 332 and the second disk portion 331, and have a suction chamber, an intermediate pressure chamber, and a discharge chamber which are formed sequentially along a proceeding direction of the wrap. As illustrated in FIG. 2, the compression chamber V may include the first compression chamber V1 formed between an inner surface of the first wrap 323 and an outer surface of the second wrap 332, and the second compression chamber V2 formed between an outer surface of the first wrap 323 and an inner surface of the second wrap 332.

In other words, the first compression chamber V1 may include a compression chamber formed between two contact points P11 and P12 generated in response to the inner surface of the first wrap 323 being brought into contact with the outer surface of the second wrap 332, and the second compression chamber V2 may include a compression chamber formed between two contact points P21 and P22 generated in response to the outer surface of the first wrap 323 being brought into contact with the inner surface of the second wrap 332.

When a large angle of angles formed between two lines, which connect a center of the eccentric portion, namely, a center O of the rotational shaft coupling portion 333 to the two contact points P11 and P12, respectively, is defined as $\alpha$ within the first compression chamber V2 just before discharge, the angle $\alpha$ at least just before the discharge is larger than 360° (i.e., $\alpha<360°$), and a distance $\ell$ between normal vectors at the two contact points (P11, P12) also has a value greater than zero. As a result, the first compression chamber V1 immediately before the discharge may have a smaller volume as compared to a case where a fixed wrap and an orbiting wrap have a shape of an involute curve. Therefore, the compression ratios of the first and second compression chambers V1 and V2 may all be improved even without increasing the sizes of the first wrap 323 and the second wrap 332.

On the other hand, as described above, the second scroll 33 may be orbitally provided between the frame 31 and the fixed scroll 32. An Oldham ring 35 that prevents rotation of the second scroll 33 may be provided between an upper surface of the second scroll 33 and a lower surface of the frame 31, and a sealing member or seal 36 that forms a back pressure chamber S1 to be explained hereinafter may be provided at an inner side rather than the Oldham ring 35.

An intermediate pressure space may be formed at an outside of the sealing member 36. The intermediate pressure space may communicates with an intermediate compression chamber of the compression chamber V, and thus, be filled with refrigerant of intermediate pressure, so as to serve as a back pressure chamber. Therefore, a back pressure chamber formed at an inside with respect to the sealing member 36 may be referred to as a "first back pressure chamber" S1, and an intermediate pressure space formed at an outside may be referred to as a "second back pressure chamber" S2. As a result, the back pressure chamber is a space formed by a lower surface of the frame 31 and an upper surface of the second scroll 33 based on the sealing member 36, and will be described hereinafter again along with the sealing member 36.

The passage separation unit 40 may be provided in the intermediate space 10*a*, which is a via space formed between a lower surface of the motor unit 20 and an upper surface of the compression unit 30, to play the role of preventing refrigerant discharged from the compression unit 30 from interfering with oil flowing from the upper space 10*b* of the motor unit 20, which is an oil separation space, to the lower space 10*c* of the compression unit 30, which is an oil storage space. The passage separation unit 40 according to this embodiment may include a passage guide that drives the first space 10*a* into a space through which refrigerant flows (hereinafter, referred to as a "refrigerant flow space") and a space through which oil flows (hereinafter, referred to as an "oil flow space"). The first space 10*a* may be divided into the refrigerant flow space and the oil flow space by only the passage guide, but according to circumstances, a plurality of passage guides may be combined to perform the role of the passage guide.

The passage separation unit 40 according to this embodiment may include a first passage guide 410 provided in the frame 31 and extending upward, and a second passage guide 420 provided in the stator 21 and extending downward. The first passage guide 410 and the second passage guide 420 may overlap each other in an axial direction to divide the intermediate space 10*a* into the refrigerant flow space and the oil flow space.

The first passage guide 410 may be formed in an annular shape and fixedly coupled to the upper surface of the frame 31, and the second passage guide 420 may extend from an insulator which is inserted into the stator 21 and insulates winding coils.

The first passage guide 410 may include a first annular wall portion or wall 411 that extends upward from an outer side, a second annular wall portion or wall 412 that extends upward from an inner side, and an annular surface portion or surface 413 that extends in a radial direction to connect the first annular wall portion 411 and the second annular wall portion 412. The first annular wall portion 411 may be formed higher than the second annular wall portion 412, and the annular surface portion 413 may be provided with a refrigerant through hole formed from the compression unit 30 to the intermediate space 10*a* in a communicating manner.

A balance weight 26 may be located at an inside of the second annular wall portion 412, namely, in a rotational shaft direction, and rotatably coupled to the rotor 22 or the rotational shaft 50. Refrigerant may be stirred while the balance weight 26 rotates, but the second annular wall portion 412 may prevent the refrigerant from moving toward the balance weight 26 to suppress the refrigerant from being stirred by the balance weight 26.

The second flow guide 420 may include a first extending portion or extension 421 that extends downward from the outside of the insulator and a second extending portion or extension 422 that extends downward from the inside of the insulator. The first extending portion 421 may overlap the first annular wall portion 411 in the axial direction to play a role of separating the refrigerant flow space from the oil flow space. The second extending portion 422 may not be formed as necessary. Even when it is formed, the second extending portion 422 may not overlap the second annular wall portion 412 in the axial direction, or may be formed at a sufficient distance from the second annular wait portion 412 in a radial direction, such that the refrigerant may sufficiently flow even if it overlaps the second annular wall portion 412.

An upper portion of the rotational shaft 50 may be press-fitted into a center of the rotor 22 while a lower portion thereof may be coupled to the compression unit 30 to be supported in the radial direction. Accordingly, the rotational shaft 50 may transfer the rotational force of the motor unit 20 to the orbiting scroll 33 of the compression unit 30. Then, the second scroll 33 eccentrically coupled to the rotational shaft 50 may perform an orbiting motion with respect to the first scroll 32.

The main bearing (hereinafter, referred to as a "first bearing") 51 may be formed at a lower portion of the rotational shall 50 to be inserted into the first bearing hole 312*a* of the frame 31 and supported in a radial direction, and a sub-bearing (hereinafter, referred to as a "second bearing") 52 may be formed at a lower side of the first bearing 51 to be inserted into the second bearing hole 326*a* of the first scroll 32 and supported in a radial direction. Further, the eccentric portion 53 may be provided between the first bearing 51 and the second bearing 52 in a manner of being inserted into the rotational shaft coupling portion 333.

The first hearing 51 and the second hearing 52 may be coaxially formed to have a same axial center, and the eccentric portion 53 may be eccentrically formed in the radial direction with respect to the first bearing 51 or the second bearing 52. The second bearing 52 may be eccentrically formed with respect to the first bearing 51.

The eccentric portion 53 should be formed in such a manner that its outer diameter is smaller than an outer diameter of the first bearing 51 and larger than an outer diameter of the second bearing 52 to be advantageous in coupling the rotational shaft 50 through the respective bearing holes 312*a* and 326*a* and the rotational shaft coupling portion 333. However, in a case where the eccentric portion 53 is formed using a separate bearing without being integrally formed with the rotational shaft 50, the rotational shaft 50 may be inserted even when the outer diameter of the second bearing 52 is not smaller than the outer diameter of the eccentric portion 53.

An oil supply passage 50*a* that supplies oil to each bearing and the eccentric portion 53 may be formed within the rotational shaft 50 along the axial direction. As the compression unit 30 is located below the motor unit 20, the oil supply passage 50*a* may be formed from a lower end of the rotational shaft 50 to approximately a lower end or a middle height of the stator 21 or a position higher than an upper end of the first bearing 31 in a groove manner. Of course, according to circumstances, the oil supply passage 50*a* may also be formed by penetrating through the rotational shaft 50 in an axial direction.

An oil feeder 60 that pumps up oil filled in the lower space 10*c* may be coupled to the lower end of the rotational shaft 50, namely, a lower end of the second hearing 52. The oil feeder 60 may include an oil supply pipe 61 inserted into the oil supply passage 50*a* of the relational shaft 50, and a blocking member 62 that blocks an introduction of foreign materials by receiving the oil supply pipe 61 therein. The oil supply pipe 61 may be located to be immersed in oil of the lower space 10*c* through the discharge cover 34.

As illustrated in FIG. 3, a sliding portion oil supply path F1 connected to the oil supply passage 50*a* to supply oil to each sliding portion may be formed in each bearing 51 and 52 and the eccentric portion 53 of the rotational shaft 50. The sliding portion oil supply path F1 may include a plurality of oil supply holes 511, 521 and 531 formed through the oil supply passage 50*a* toward an outer circumferential surface of the rotational shaft 50, and a plurality of oil supply grooves 512, 522, and 552 that communicates with the oil supply holes 511, 521 and 531, respectively, to lubricate each bearing 51, 52 and the eccentric portion 53.

For example, the first oil supply hole 511 and the first oil supply groove 512 may be formed in the first bearing 51, and the second oil supply hole 521 and the second oil supply groove 522 may be formed in the second hearing 52. The third oil supply hole 531 and the third oil supply groove 532 may be formed in the eccentric portion 53. Each of the first oil supply groove 512, the second oil supply groove 522, and the third oil supply groove 532 may be formed in a slot shape extending in an axial or inclined direction.

A first connection groove 541 and a second connection groove 541 each formed in an annular shape may be formed between the first bearing 51 and the eccentric portion 53 and between the eccentric portion 53 and the second bearing 52, respectively. The first connection groove 541 may communicate with a lower end of the first oil supply groove 512 and the second oil supply groove 522 may be connected with the second connection groove 542. Accordingly, a part or portion of oil that lubricates the first bearing 51 through the first oil supply groove 512 may flow down to be collected in the first connection groove 541, and then introduced into the first back pressure chamber S1, thereby forming back pressure of discharge pressure. Oil that lubricates the second bearing 52 through the second oil supply groove 522 and oil that lubricates the eccentric portion 53 through the third oil supply groove 532 may be collected into the second connection groove 542, and then introduced into the compression unit 30 through a space between a front end surface of the rotational shaft coupling portion 333 and the first disk portion 321.

In addition, a small amount of oil suctioned up toward an upper end of the first hearing 51 may flow out of a bearing surface from an upper end of the first bearing portion 312 of the frame 31 and flow down toward an upper surface 31*a* of the frame 31 along the first shaft bearing portion 312. Afterwards, the oil may be collected in the lower space 10*c* through the oil passages $P_{O1}$ and $P_{O2}$ consecutively formed on an outer circumferential surface of the frame 31 (or a groove that communicates from the upper surface to the outer circumferential surface) and an outer circumferential surface of the first scroll 32.

Oil discharged from the compression chamber V to the upper space 10*b* of the casing 10 together with refrigerant may be separated from the refrigerant in the upper space 10*b* of the casing 10 and collected into the lower space 10*c* through the first oil passage $P_{O1}$ formed on an outer circumferential surface of the motor unit 20 and the second oil passage $P_{O2}$ formed on an outer circumferential surface of the compression unit 30. The passage separation unit 40 may be provided between the motor unit 20 and the compression unit 30. Accordingly, oil which is separated from refrigerant in the upper space 10*b* may flow toward the lower space 10*c* along the passages $P_{O1}$ and $P_{O2}$, without being re-mixed with refrigerant which is discharged from the compression unit 20 and flows toward the upper space 10*b*, and the refrigerant moving toward the upper surface 10*b* may flow toward the upper pace 10*b* along the passages $P_{G1}$ and $P_{G2}$.

The second scroll 33 may be provided with a compression chamber oil supply path F2 that supplies oil suctioned up through the oil supply passage 50*a* into the compression chamber V. The compression chamber oil supply path F2 may be connected to the sliding portion oil supply path F1.

The compression chamber oil supply path F2 may include a first oil supply path 371 that communicates the oil supply passage 50*a* with the second back pressure chamber S2 forming an intermediate pressure space, and a second oil supply path 372 that communicates the second back pressure chamber S2 with the intermediate pressure chamber of the compression chamber V. The compression chamber oil supply path may also be formed to communicate directly with the intermediate pressure chamber from the oil supply passage 50*a* without passing through the second back pressure chamber S2. In this case, however, a refrigerant passage that communicates the second back pressure chamber S2 with the intermediate pressure chamber V should be separately provided, and an oil passage that supplies oil to the Oldham ring 35 located in the second back pressure chamber S2 should be separately provided. This causes an increase in a number of passages and complicates processing. Therefore, in order to reduce the number of passages or paths by unifying the refrigerant passage and the oil passage, as described in this embodiment, it may be necessary to communicate the oil supply passage 50*a* with the second back pressure chamber S2 and the second back pressure chamber S2 with the intermediate pressure chamber V.

The first oil supply path 371 may be provided with a first orbiting passage portion or passage 371*a* formed from an upper surface down to a middle of the second disk portion 331 in a thickness direction, a second orbiting passage portion or passage 371*b* formed from the first orbiting passage portion 371*a* toward an outer circumferential surface of the second disk portion 331, and a third orbiting passage portion or passage 371*c* formed through the upper surface of the second disk portion 331 from the second orbiting passage portion 371*b*. The first orbiting passage portion 371*a* may be located at a position belonging to the first back pressure chamber S1, and the third orbiting passage portion 37*c* may be located at a position belonging to the second back pressure chamber S2. Further, a pressure reducing rod 375 may be inserted into the second orbiting passage portion 371*b* to reduce pressure of oil which flows from the first back pressure chamber S1 to the second back pressure chamber S2 through the first oil supply passage 371. Accordingly, a sectional area of the second orbiting passage portion 371*b* excluding the pressure reducing rod 375 may be formed to be smaller a sectional area that of the first orbiting passage portion 371*a* or the third orbiting passage portion 371*c*.

In a case where an end portion of the third orbiting passage portion 371*c* is formed to be located at an inside of the Oldham ring 35, namely, between the Oldham ring 35 and the sealing member 36, oil flowing through the first oil supply passage 371 may be blocked by the Oldham ring 35, and thus, may not smoothly flow to the second back pressure chamber S2. Therefore, in this case, a fourth orbiting passage portion or passage 371*d* may be formed from the end portion of the third orbiting passage portion 371*c* toward an outer circumferential surface of the second disk portion 331. The fourth orbiting passage portion 371*d* may be formed as a groove on an upper surface of the second disk portion 331, as illustrated in FIG. 4, or may be formed as a hole within the second disk portion 331.

The second oil supply passage 372 may be provided with a first fixed passage portion or passage 372*a* on an upper surface of the second sidewall portion 322 in a thickness direction, a second fixed passage portion or passage 372*b* formed from the first fixed passage portion 372*a* in a radial direction, and a third fixed passage portion or passage 372*c* that communicates the second fixed passage portion 372*b* with the intermediate pressure chamber V.

In the drawings, unexplained reference numeral 70 denotes an accumulator.

A lower compression type scroll compressor according to an embodiment may operate as follows.

That is, when power is applied to the motor unit 20, a rotational force may be generated and the rotor 21 and the rotational shaft 50 may be rotated by the rotational force. As the rotational shaft 50 rotates, the orbiting scroll 33 eccentrically coupled to the rotational shaft 50 may perform an orbiting motion due to the Oldham ring 35.

Then, refrigerant supplied from an outside of the casing 10 through the refrigerant section pipe 15 may be introduced into the compression chamber V, and compressed as a volume of the compression chamber V is reduced by the orbiting motion of the orbiting scroll 33. The refrigerant may then be discharged into an inner space of the discharge cover 34 through the first discharge port 325*a* and the second discharge port 325*b*.

Then, noise may be reduced from the refrigerant discharged into the inner space of the discharge cover 34 while the refrigerant circulates within the inner space of the discharge cover 34. The noise-reduced refrigerant may flow to a space between the frame 31 and the stator 21, and then be introduced into an upper space of the motor unit 20 through a gap between the stator 21 and the rotor 22.

Oil may be separated from the refrigerant in the upper space of the motor unit 20. Accordingly, the refrigerant may be discharged out of the casing 10 through the refrigerant discharge pipe 16, while the oil may be collected back into the lower space 10*c* as the oil storage space of the casing 10 through a passage between the inner circumferential surface of the casing 10 and the stator 21 and a passage between the inner circumferential surface and the outer circumferential surface of the compression unit 30. This series of processes may be repeated.

The oil in the lower space 10*c* may be suctioned up through the oil supply passage 50*a* of the rotational shaft 50, so as to lubricate the first bearing 51, the second bearing 52, and the eccentric portion 53 through the oil supply holes 511, 521 and 531 and the oil supply grooves 512, 522 and 532, respectively. Oil that lubricates the first bearing 51 through the first oil supply hole 511 and the first oil supply groove 512 may be collected into the first connection groove 51 between the first bearing 51 and the eccentric portion 53, and then introduced into the first back pressure chamber S1. This oil forms a substantial discharge pressure, and thus, the first back pressure chamber S1 may also be filled with substantial discharge pressure. Therefore, a central portion of the second scroll 33 may be supported by the discharge pressure in an axial direction.

The oil in the first back pressure chamber S1 may be moved to the second back pressure chamber S2 through the first oil supply passage 371 due to a pressure difference from the second back pressure chamber S2. The pressure reducing rod 375 provided in the second orbiting passage portion 371*b* forming the first oil supply passage 371 allows pressure of the oil flowing toward the second back pressure chamber S2 to be reduced to an intermediate pressure.

The oil moving to the second back pressure chamber (intermediate pressure space) S2 may support the edge portion of the second scroll 33, and simultaneously, and flow to the intermediate pressure chamber V through the second oil supply passage 372 duo to a pressure difference with the intermediate pressure chamber V. However, when pressure in the intermediate pressure chamber V becomes higher than the pressure in the second back pressure chamber S2 during operation of the compressor, the refrigerant in the intermediate pressure chamber V may flow through the second oil supply passage 372 into the second back pressure chamber S2. In other words, the second oil supply passage 372 plays a role of a passage through which the refrigerant and the oil alternatively flow according to the pressure difference between the second back pressure chamber S2 and the intermediate pressure chamber V.

As described above, the back pressure chamber is formed on the rear surface of the second scroll, that is, on an upper surface of the second scroll, to prevent the second scroll from being moved away from the first scroll by the pressure of the compression chamber. That is, in the back pressure chamber, sealing members are provided on a lower surface of the frame and an upper surface of the second scroll. Accordingly, the first back pressure chamber is formed between the second scroll and the frame, and the second back pressure chamber is formed by the second scroll, the frame and the first scroll.

The sealing members may made of a material which can provide an excellent sealing force between the frame and the second scroll, and has high abrasion resistance in consideration of friction caused by the orbiting motion of the second scroll. In addition, each of the sealing members may be formed of a material and structure that can be quickly lifted even at low pressure because the sealing member is axially sealed while being lifted by pressure in a state of being inserted into a sealing member insertion groove provided in the second scroll.

On the other hand, as described above, as the first back pressure chamber which is a central portion of the second scroll forms the discharge pressure and the second back pressure chamber which is an edge portion forms the intermediate pressure, back pressure generated at the central portion of the second scroll is higher than back pressure generated at the edge portion. The central portion of the second scroll is pressed more than the edge portion in a direction toward the first scroll, and accordingly, the discharge end of the first wrap located at the central portion of the first scroll excessively adheres to the second disk portion. At the same time, the central portion of the first wrap forms the discharge end to receive the discharge pressure. Due to the discharge pressure, the discharge end of the first wrap is subjected to a strong gas force in a direction toward the edge and a centrifugal force generated during operation.

Thus, the discharge end of the first wrap receives a pressing force in the axial direction by the high back pressure of the first back pressure chamber, and a pushing force in the radial direction by a gas force of the discharge pressure. As a result, the discharge end of the first wrap may be bent outward from a root of the wrap toward a front end surface of the wrap, that is, in a height direction of the wrap.

Such a phenomenon may occur severely when the second shaft hole through which the rotational shaft is inserted is formed through the central portion of the first scroll, which is the fixed scroll, as illustrated in this embodiment. That is, when the second bearing hole is formed through the central portion of the first scroll, the discharge end of the first wrap, which is the fixed wrap, does not extend to the central portion of the first scroll due to the second bearing hole, and thereby is located far away from the central portion of the scroll. As a result, a rigidity of the wrap at the discharge end is lowered and deformation of the wrap increases.

This phenomenon may occur more severely when the compression ratio is increased by changing the first wrap and the second wrap to have an atypical shape, as illustrated in this embodiment. In this embodiment, however, a protrusion is formed on the discharge end of the first wrap to improve a wrap supporting force to some extent, but the wrap supporting force may not be increased as much as an increased compression ratio. This may be likely to cause frictional loss or abrasion due to the wrap deformation or a wrap fracture at the discharge end of the first wrap. To explain this, FIG. 5 is a schematic view illustrating a deformation amount in a vicinity of the discharge end of the first wrap on a portion basis, and FIG. 6 is a front schematic view illustrating a wrap shape at a portion having a largest deformation amount in FIG. 5.

Figure 5:
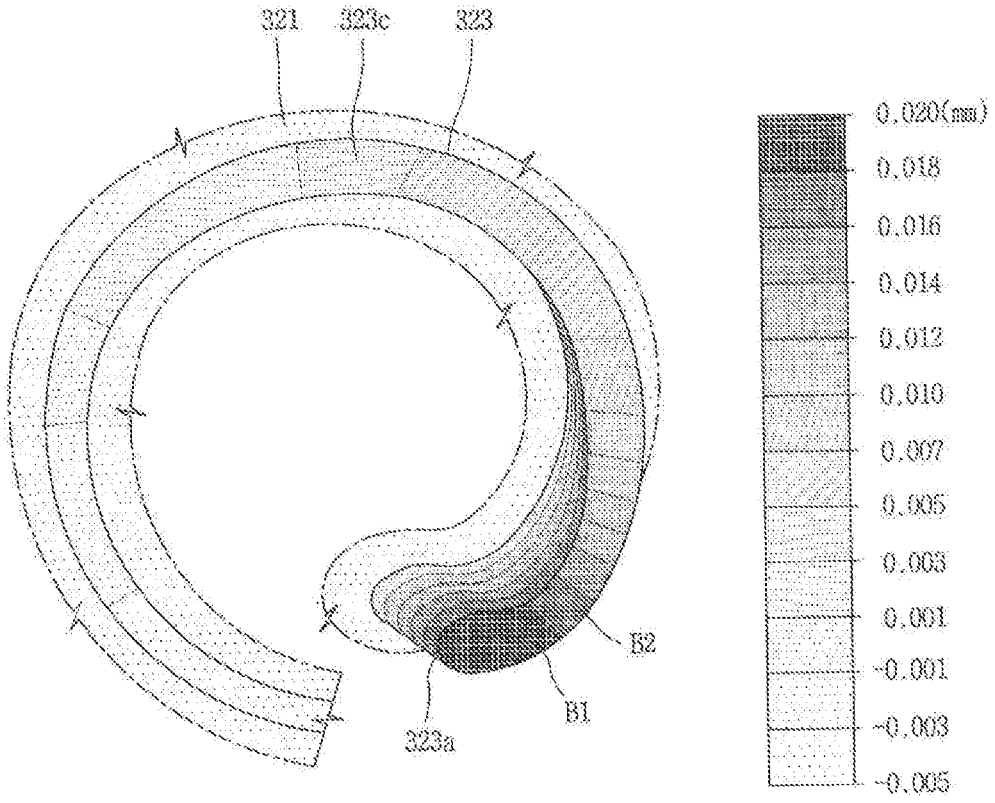
FIG. 5 is a schematic view illustrating an amount of deformation around a discharge end of a first wrap in the scroll compressor of FIG. 1, on a partial basis.

As illustrated in FIG. 5, the amount of deformation at the discharge end 323*a* of the first wrap 332 is the largest in the range of about 0.018 mm to 0.02 mm, and gradually decreases from the discharge end 323*a* toward a suction end. The deformation amount of the first disk portion 321 including the vicinity of the discharge end 323*a* of the first wrap 323 may approximately range from −0.003 mm to −0.005 mm. It can be seen that the first disk portion 321 is slightly deformed due to a force applied thereto in a direction opposite to a direction in which the first wrap 323 is deformed.

Figure 6:
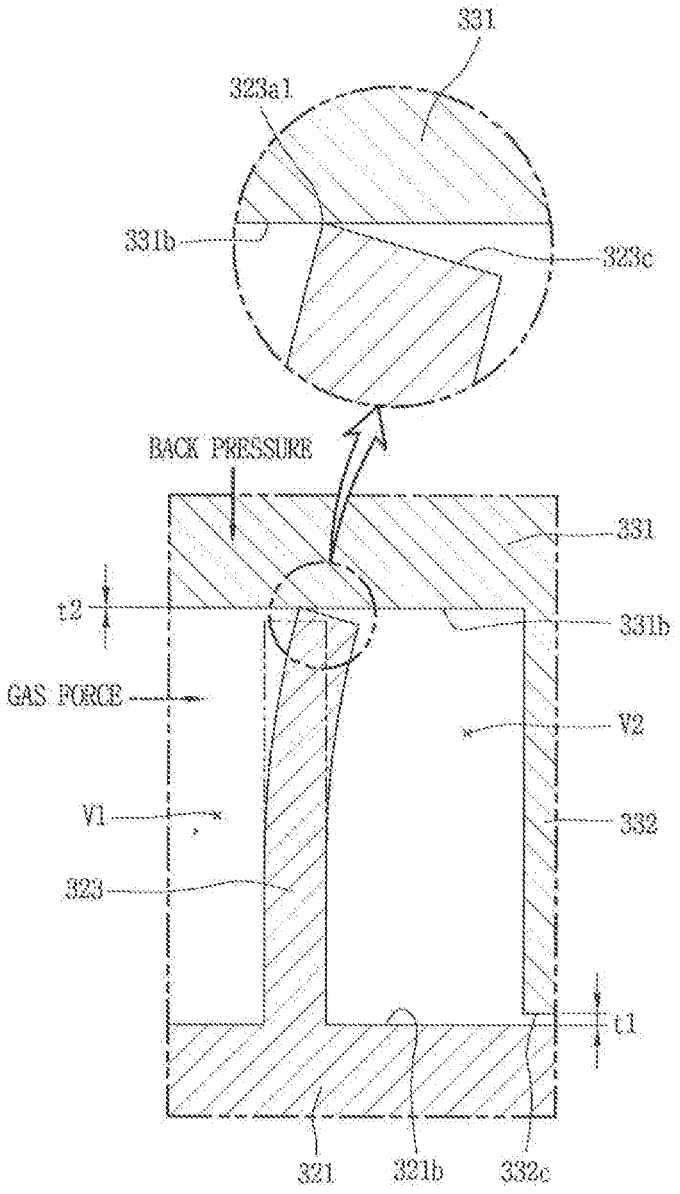
FIG. 6 is a front schematic view of a wrap shape at a portion having a largest deformation amount in FIG. 5.

Accordingly, as illustrated in FIG. 6, an end surface in the vicinity of the discharge end 323*a* receives the gas force so as to be bent toward a right side in the drawing, that is, from the central portion toward the edge portion. During this, an inner edge 323*a*1 of the discharge end 323*a* is located at a highest point so as to be brought into contact with a lower surface of the second disk portion 331.

The second scroll receives the back pressure and is pushed downward in the drawing. However, as the discharge end 323*a* of the first wrap 323 is deformed by being bent outward, the discharge end 323*a* of the first wrap, 323 and a lower surface 331*b* of the second disk portion 331 are first brought into contact with each other just before an upper surface 321*b* of the first disk portion 321 and an end surface 332*c* of the second wrap 323 are brought into contact with each other by the back pressure. That is, a distance t1 between the upper surface 321*b* of the first disk portion 321 and the end surface 332*c* of the second wrap 332 is longer than a distance t2 between the discharge end 323*a* of the first wrap 323 and the lower surface 331*b* of the second disk portion 331. Accordingly, while the distance t2 between the end surface 323*c* of the first wrap 323 and the lower surface 331*b* of the second disk portion 331 is removed by the back pressure, the fractional loss or abrasion described above may occur between the upper surface 321*b* of the first disk portion 321 and the end surface 332*c* of the second wrap 332 or a portion of the first wrap 323 in the vicinity of the discharge end thereof may be broken.

In view of this, in this embodiment, a wrap height in the vicinity of the discharge end may be optimized so as to minimize forces applied to the wrap, namely, a force in the axial direction generated by the back pressure and a force in the radial direction generated by the gas force, thereby preventing the frictional loss or abrasion between the wrap and the disk portion or the wrap breakage. FIGS. 7 to 10B are drawings showing this.

As illustrated in these drawings, the first wrap 323 according to this embodiment may be formed such that the wrap height gradually decreases from an end of the edge portion constituting a suction end 323*b* toward an end of the central portion constituting the discharge end 323*a*. As a result, the end surface of the central portion or the wrap may be prevented from excessively adhering to the disk portion of the opposing scroll. Generally, the scroll compressor is characterized in that pressure and temperature of the compression chamber increase toward the central portion of the scroll, and a thermal expansion rate of the wrap also increases toward the central portion (discharge end). Accordingly, the end surface of the central portion of the wrap may excessively adhere to the disk portion of the opposing scroll. However, when the wrap height is lowered toward the central portion, as illustrated in this embodiment, the excessive adhesion between the wrap of the central portion and the disk portion may be prevented.

Figure 7:
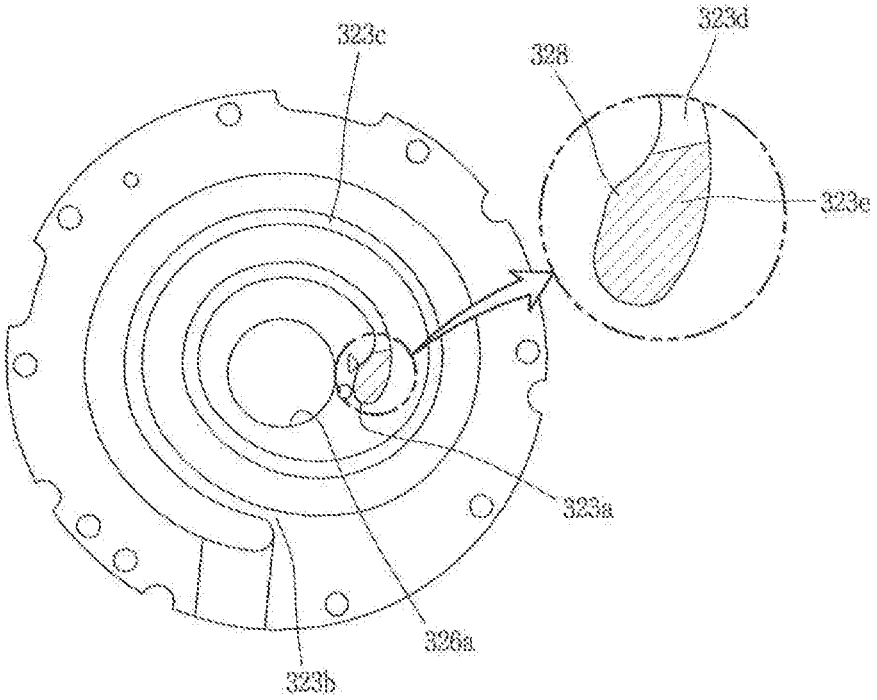
FIG. 7 is a planar view illustrating a first scroll according to an embodiment.
Figure 8:
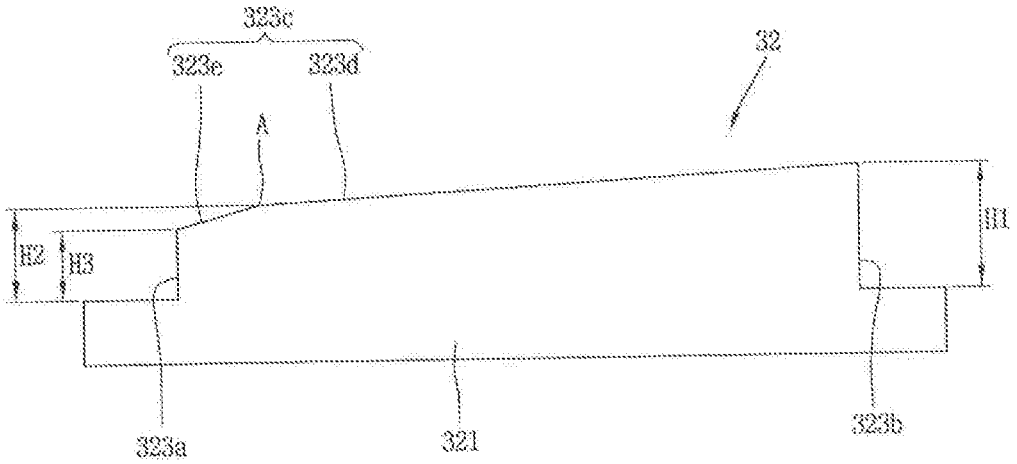
FIG. 8 is a schematic view of a first wrap in FIG. 7.

However, as the first wrap 323 according to this embodiment is formed such that an envelope is sharply bent together with the second wrap 332 to increase a compression length of the first compression chamber V1, the compression ratio greatly increases as compared with an arc compression method employing a typical involute shape. In this manner, as the compression ratio of the first compression chamber VI increases, the discharge end 323*a* of the first wrap 323 is pushed by a gas force of high pressure in the radial direction (including the axial direction but roughly referred to as the radial direction). Accordingly, an end portion of the discharge end 323*a* is bent outward, and the end surface 323*c* of the discharge end 323*a* is brought into contact with the lower surface 331*b* of the second disk portion 331 by the bent degree, thereby causing abrasion. Therefore, in this embodiment a portion of the end surface of the first wrap, which is adjacent to the discharge end, may be further inclined. FIG. 7 is a planar view of the first scroll according to this embodiment, and FIG. 8 is a schematic view the first wrap having a two-step inclined surface according to this embodiment.

As illustrated in these drawings, the first wrap 323 according to this embodiment is provided with a first inclined surface 323*d* having a first inclination machining amount from the suction end 323*b* to any arbitrary point A, and a second inclined surface 323*e* having a second inclination machining amount, larger than the first inclination machining amount, from the arbitrary point A to the discharge end 323*a*. That is, as illustrated in FIG. 8, a wrap height H2 at the arbitrary point is lower than a wrap height H1 at the suction end, and a wrap height H3 at the discharge end is lower than the wrap height H2 at the arbitrary point A. A position of the arbitrary point A may be determined in consideration of reliability of the compressor, which will be explained hereinafter together with a range of the inclined surface.

Figure 9A:
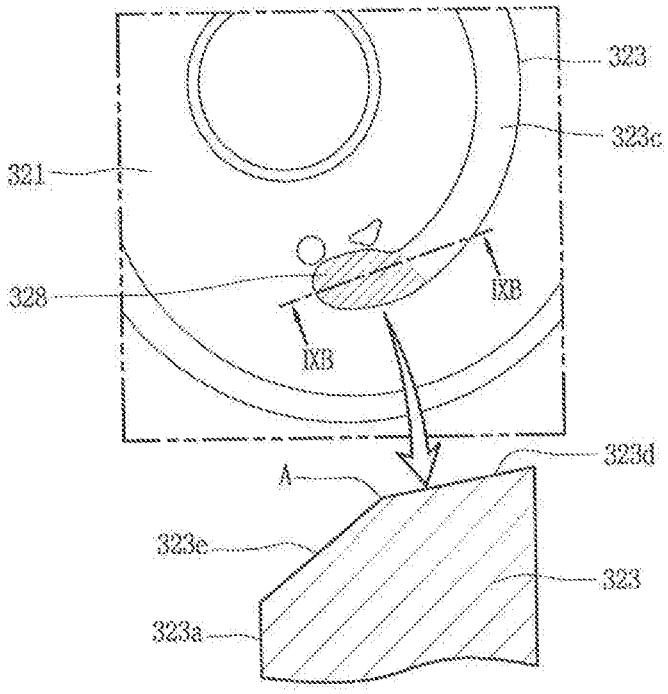
FIG. 9A is a schematic view illustrating one embodiment of a second inclined surface according to the embodiment illustrated in FIG. 7.
Figure 9B:
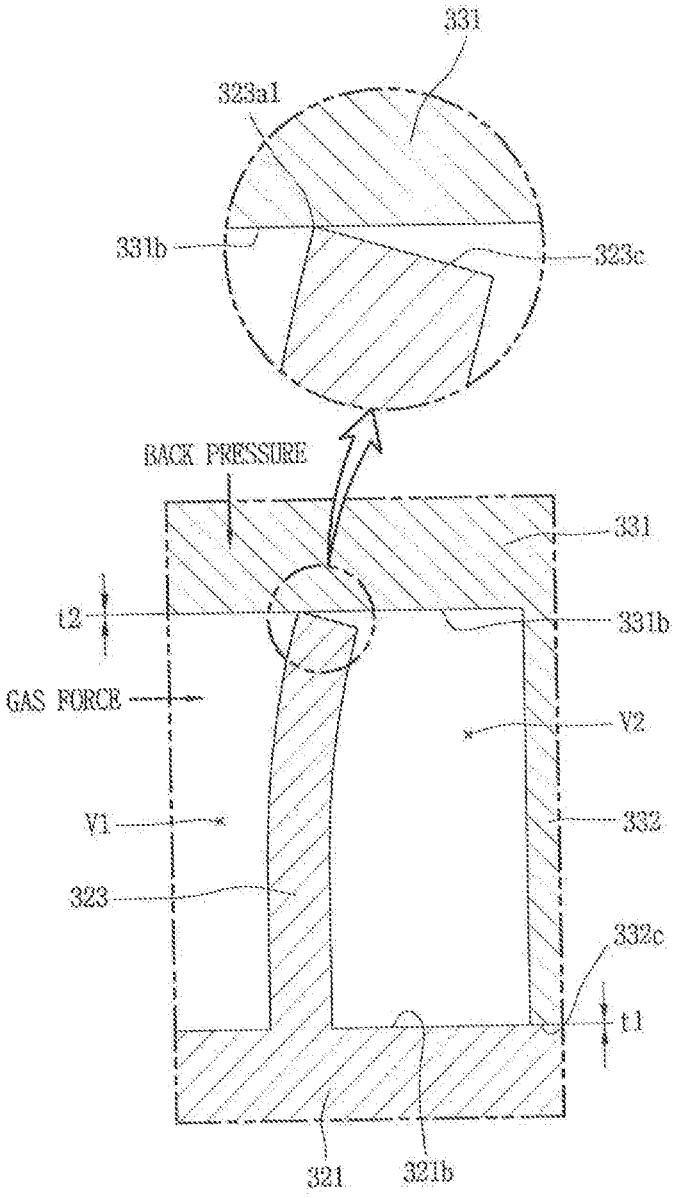
FIG. 9B is a sectional view taken along the line IXB-IXB of FIG. 9A.

On the other hand, the second inclined surface may be formed on the entire end surface of the wrap from the discharge end to an arbitrary point, and may be formed on an inner edge of the discharge end in consideration of outward bending of the discharge end. FIGS. 9A and 9B illustrate the former, and FIGS. 10A and 10B illustrate the latter, respectively.

That is, as illustrated in FIG. 9A, the second inclined surface 323*e* according to this embodiment may be formed to extend from the discharge end 323*a* to the arbitrary point A on the entire end surface 323*c* of the first wrap 323 by the same second inclination machining amount. In this case, as illustrated in FIG. 9B, as the vicinity of the discharge end 323*a* is bent outward, the inner edge 323*a*1 is brought into contact with the lower surface 331*b* of the second disk portion 331. However, even if the end surface 332*c* of the second wrap 332 closely adheres to the upper surface 321*b* of the first disk portion 321, the end surface (inner edge) 323*c* of the first wrap 323 and the lower surface 331*b* of the second disk portion 331 may appropriately be brought into contact with each other. This may result in preventing an occurrence of the frictional loss or abrasion between the first wrap 323 and the second disk portion 331 or the wrap breakage.

Figure 10A:
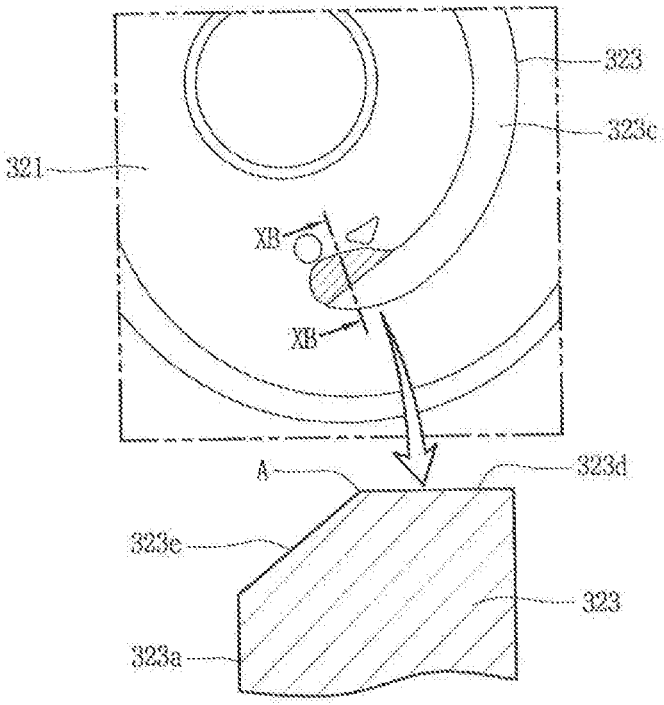
FIG. 10A is a schematic view illustrating another embodiment of the second inclined surface according to the embodiment illustrated in FIG. 7.
Figure 10B:
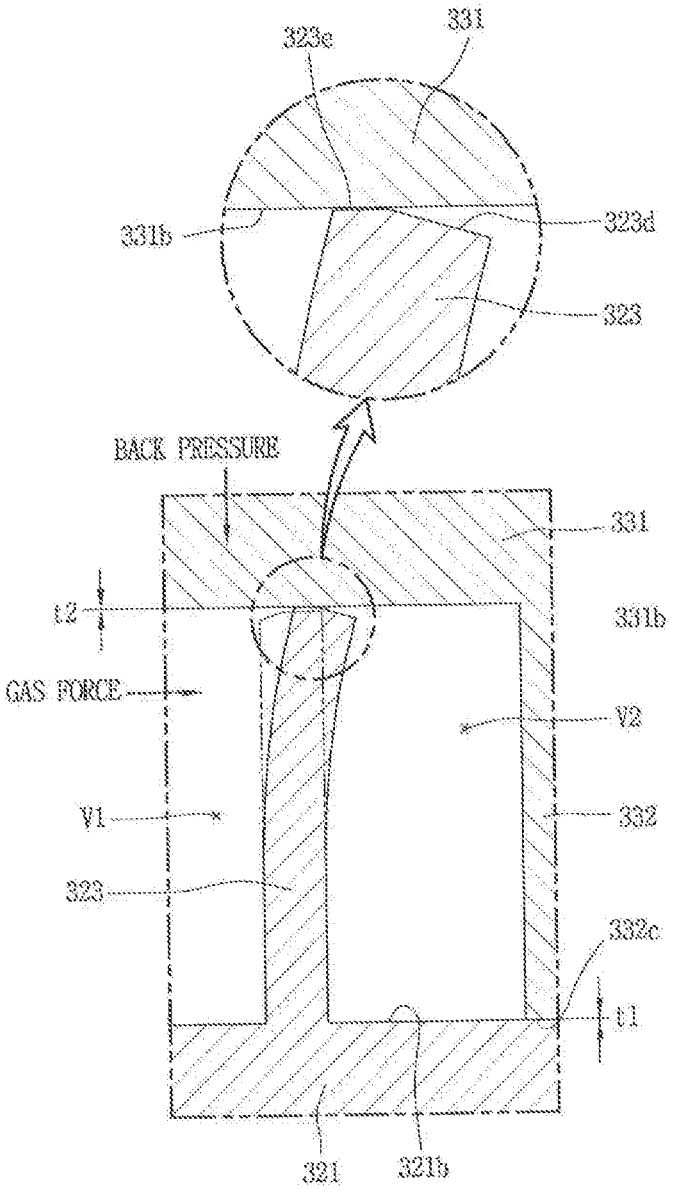
FIG. 10B is a sectional view taken along the line XB-XB in FIG. 10A.

As illustrated in FIG. 10A, the second inclined surface 323*e* according to this embodiment may be formed within a range from the discharge end 323*a* to an arbitrary point A, more specifically, formed on the inner edge 323*a*1. Accordingly, when the end surface 323*c* in the vicinity of the discharge end 323*a* is bent, the inner edge protrudes more than an outer edge so as to be brought into contact with the lower surface 331*a* of the second disk portion 331. However, when the second inclined surface 323*e* is formed by chamfering the inner edge, the height H3 of the discharge end of the first wrap 323 which is substantially brought into contact with the lower surface 331*b* of the second disk portion 331 may be lowered, thereby preventing or minimizing an excessive contact with the second disk portion 331. In addition, the second inclined surface 323*e* may ideally form a surface facing the second disk portion 331 in parallel, for example, thereby preventing the second disk portion from being brought into contact with a sharpened portion such as a corner. With this structure, when the second scroll 33 is made of an aluminum material which is relatively soft compared to the first scroll 32, abrasion of the second disk portion 331 of the second scroll 33 due to the first wrap 323 of the first scroll 32 may be effectively prevented.

Accordingly, even if the first wrap 323 is bent outward in the vicinity of the discharge end as the central portion of the first scroll, the end surface 323*c* of the first wrap 323 may be prevented from being abraded due to excessive adhesion to the lower surface 331*b* of the second disk portion 331. This may result in preventing or minimizing not only the abrasion of the first wrap caused by bending the first wrap 323, but also a phenomenon that the discharge end 323*a* excessively adheres to the second disk portion 331, which results from that a thermal expansion at the discharge end 323*a* is greatly increased due to remarkably increased pressure and temperature of a final compression chamber including the discharge end 323*a*, compared with those of a compression chamber at an upstream side.

The range of the second inclined surface 323*e* may be considered in terms of reliability. For example, when the second inclined surface 323*e* is formed only within a range too close to the discharge end 323*a*, the problem that the end surface 323*c* of the first wrap 323 adheres closely to the lower surface 331*b* of the second disk portion 331 may not be sufficiently suppressed. That is, based on FIG. 5, the second inclined surface 323*e* may be formed over an entire area of a first section B1 where a deformation rate is in the range of about 0.018 to 0.020 mm.

However, when the second inclined surface 323*e* does not include the entire area of the first section B1, a part or portion to the left section B1, that is, a part or portion adjacent to a second section B2 forms the first inclined surface 323*d* and excessively adheres to the lower surface 331*b* of the second disk portion 331. Accordingly, frictional loss or abrasion may still occur and the vicinity of the discharge end of the wrap may be damaged. On the other hand, when the second inclined surface 323*e* is formed with the same inclination machining amount from the discharge end 323*a* to a range far from the discharge end 323*a*, that is, to the second section B2 or more, a gap may generated between the end surface 323*c* of the first wrap 323 and the lower surface 331*a* of the second disk portion 331, thereby causing leakage of refrigerant.

Therefore, the range of the second inclined surface 323*e* formed with the second inclination machining amount may be formed as a first range B1 based on FIG. 5, namely, formed to include at least a part or portion of a range of about 30 to 60° from the discharge end 323*a* when the discharge end 323*a* is about 0°. More precisely, the second inclined surface 323*e* may be formed within a range from about 0° to about 40 to 50°. In this case, the protruding portion 326 of the first wrap described above may be included in the range in which the second inclined surface is formed.

Figure 11:
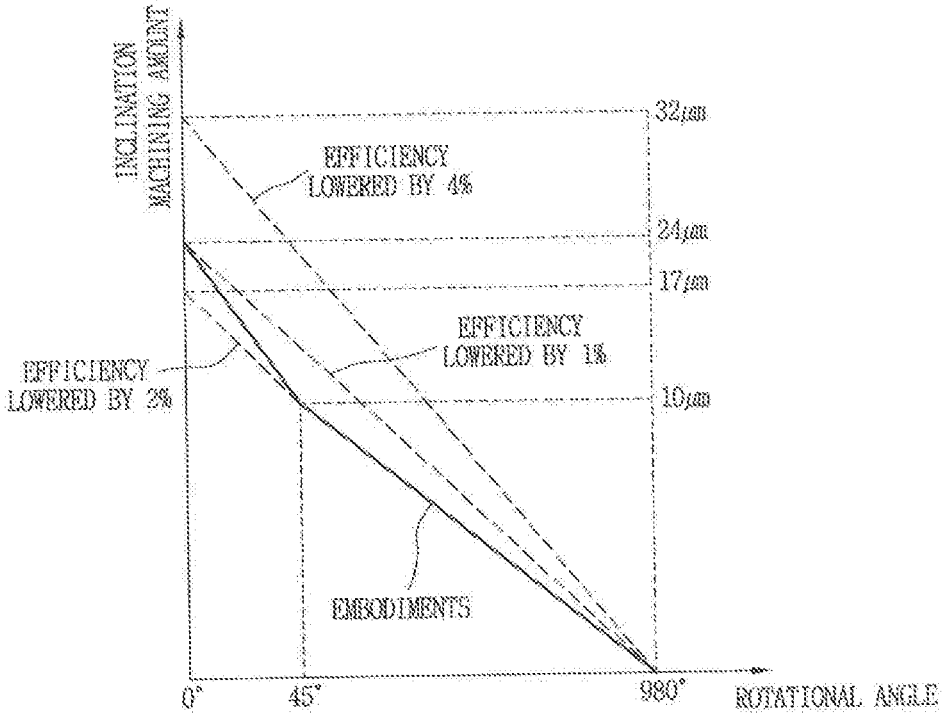
FIG. 11 is a graph comparing efficiency and reliability of the compressor according to each inclination machining amount when the first scroll according to FIG. 7 is applied.

FIG. 11 is a graph comparing efficiency and reliability of the compressor according to the inclination machining amount by specifying the range of the second inclined surface in the range of about 0 to 45°. This is the result of analysis by designing the wrap height to be about 26 mm and the maximum processing depth to be about 24 μm.

As illustrated in the drawing, when the end surface 323*c* of the first wrap 323 is inclined as a single inclined surface from the discharge end 323*a* (0°) to the suction end 323*b* (980°), and a maximum processing depth at the discharge end 323*a* is about 32 μm which is larger than that in this embodiment, efficiency is reduced by about 4% as compared with this embodiment. This is because the processing depth in the vicinity of the discharge end 323*a* is excessively generated, and refrigerant leakage occurs accordingly.

Also, when the end surface 323*c* of the first wrap 323 is inclined as a single inclined surface from the discharge end 323*a* to the suction end 323*b*, and the maximum processing depth at the discharge end 323*a* is about 24 μm which is the same as that in this embodiment, the efficiency is reduced by about 1% as compared with this embodiment. This is because the frictional loss occurs in the vicinity of the discharge end 323*a*.

However, as illustrated in this embodiment, the first inclined surface 323*d* is formed to a 45° point from the suction end 323*b* and the second inclined surface 323*e* is formed to the discharge end 323*a* from the 45° point. In this instance, when the two-step inclined surface is formed in a manner that the inclination machining amount of the second inclined surface 323*e* is larger than that of the first inclined surface 323*d* and the maximum processing depth at the discharge end 323*a* is about 24 μm, remarkably good results are obtained in terms of efficiency or reliability, as compared with the above two examples.

For reference, as illustrated in this embodiment, in a case where the end surface of the wrap is formed by the first inclined surface and the second inclined surface with reference to 45°, when the maximum processing depth at the discharge end is about 17 μm and the processing depth of 45° is about 10 μm as the same as that in this embodiment, it can be seen that the efficiency is rather lowered by about 2%. This is because frictional loss occurs near the discharge end 323*a*.

The inclination machining amount of the first inclined surface and the inclination machining amount of the second inclined surface according to this embodiment may be respectively limited to numerical values as follows. That is, if it is assumed that the maximum height of the first wrap is H1, the inclination machining amount on the first inclined surface is H2, and the inclination machining amount on the second inclined surface is H3, they may be set to meet $$H2<[(0.001\sim0.002)\times H1]\text{mm, and}$$

$$H3>[(0.01\sim0.03)\times H1]\text{mm.}$$

Figure 12:
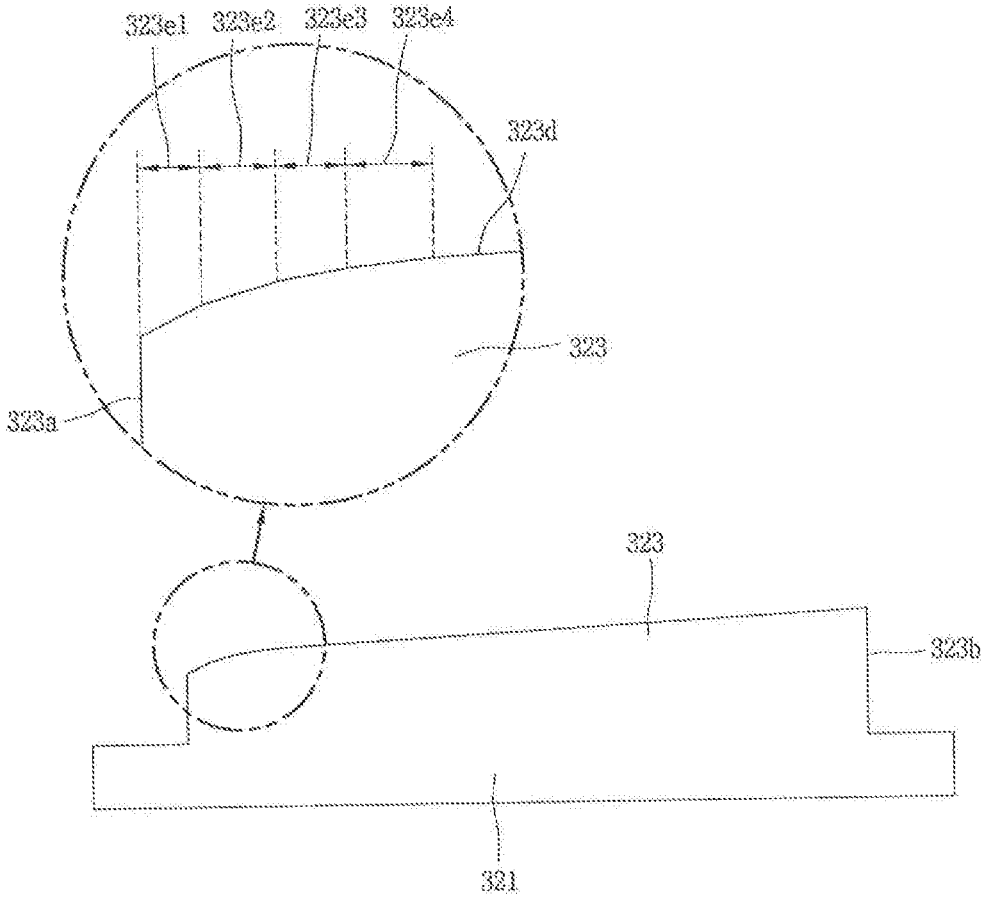
FIG. 12 to 13B are schematic views illustrating other embodiments of a second inclined surface.

Hereinafter, description will be given of another embodiment of a second inclined surface. That is, the foregoing embodiment illustrates that the second inclined surface has a single inclination angle. However, as illustrated in FIG. 12, second inclined surfaces 323*e*1 to 323*e*4 according to this embodiment are formed to have a plurality of inclination angles.

Figure 13A:
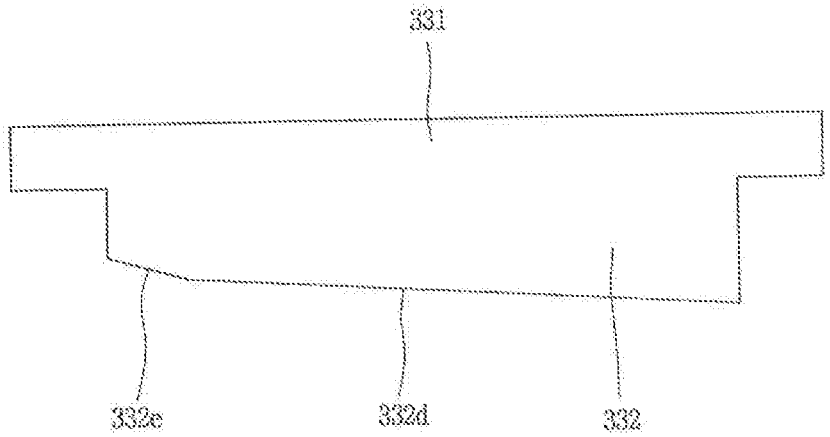
Figure 13B:
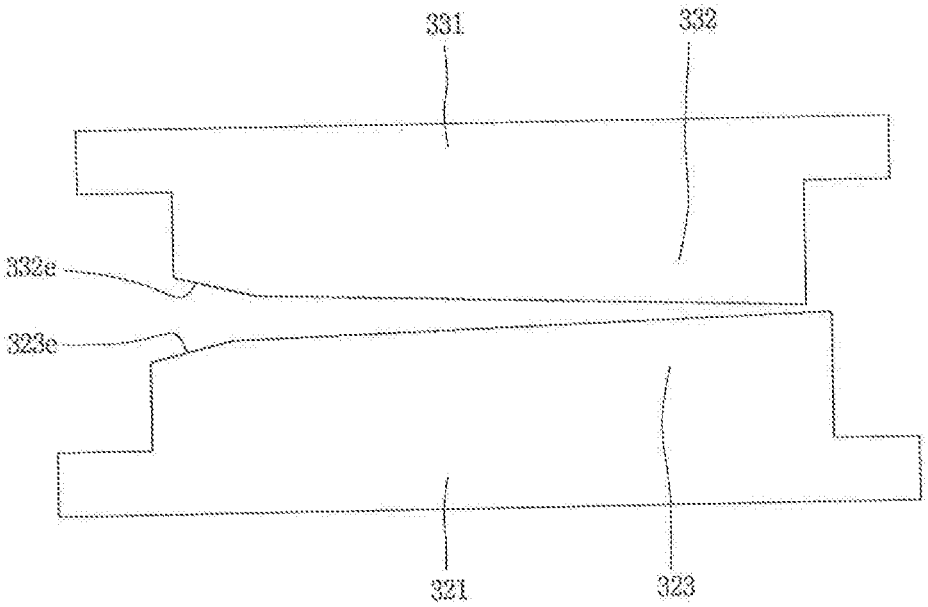

In this case, the second inclined surfaces 323*e*1 to 323*e*4 may be formed so that the inclination angles gradually increase toward the discharge end 323*a*, considering the amount of deformation of the wrap. Also, as illustrated in FIG. 13A, the second inclined surface 332*e* according to this embodiment may be formed on the second wrap 332 of the second scroll, which is the orbiting scroll. On the other hand, as illustrated in FIG. 13B, the second inclined surfaces 323*e* and 332*e* may be formed on end surfaces of the first wrap 323 and the second wrap 332, respectively.

However, for the second wrap 332, as the thick rotational shaft coupling portion is formed at the discharge end which is the central portion, the discharge end of the second wrap 332 is not greatly likely to be deformed or damaged by relatively high pressure. However, the discharge end of the second wrap 332 forming the rotational shaft coupling portion may also expand due to an increased temperature of the compression chamber resulting from an increase in a compression ratio.

Accordingly, the end surface of the discharge and of the second wrap 332 may excessively adhere to the first disk portion 321 that the end surface of the discharge end faces, which may increase fictional loss or cause abrasion between the second wrap 332 and the first disk portion 321. In this case, the second inclined surfaces 323*e* and 332*e* may be formed at one or a plurality or inclination angles. The basic configuration for the second inclined surface may be the same as that in the previous embodiment. Therefore, detailed description thereof has been omitted.

However, even when the second inclined surfaces 323*e* and 332*e* are formed on the first and second wraps 323 and 332, respectively, the first and second wraps 323 and 332 may be brought into contact with the disk portions of the scrolls that they face. Therefore, the inclination machining amounts of the first wrap and the second wrap may be formed to be the same as that in the previous embodiments.

Hereinafter, description will be given of other embodiments of the wrap shape in the scroll compressor according to embodiments. The previous embodiment illustrates that the height of the discharge end of the wrap is optimized so as to suppress excessive contact with the scroll that the discharge end of the wrap faces. However, in this embodiment, a wrap rigidity near the discharge end may be optimized, so as to minimize the wrap deformation even though the wrap receives the force in the axial direction generated by the back pressure and the force in the radial direction generated by the gas force and accordingly prevent frictional loss or abrasion between the wrap and the disk portion or the wrap breakage.

Figure 14:
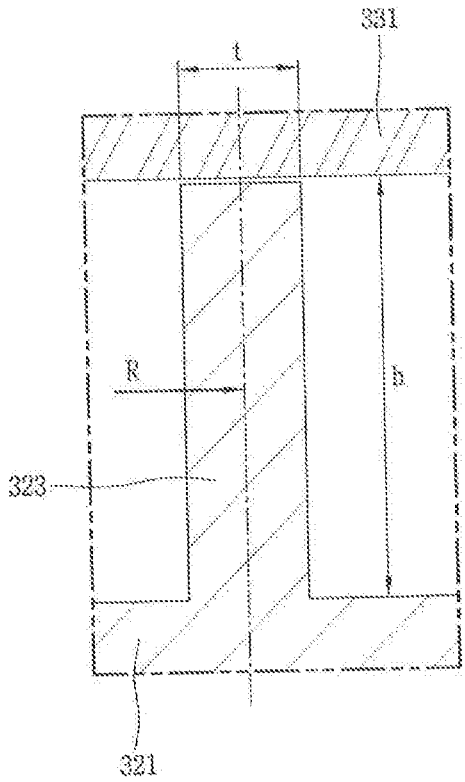
FIG. 14 is a schematic view of a discharge end of a wrap according to an embodiment.

The first wrap according to this embodiment may be implemented in a manner that a range of a rigidity coefficient of the wrap in the vicinity of the discharge end, which is defined as follows, satisfies an optimal limit line range. That is, as illustrated in FIG. 14, a first value is obtained by dividing an average height h of the central portion of the wrap by an average thickness t of the central portion of the wrap, and a second value is obtained by multiplying the first value and an average curvature radius R, which is a distance between a center of the rotational shaft, that is, a center of the second bearing hole, with respect to the central portion of the wrap and a center line of the first wrap. The rigidity coeffeicient A of the first wrap in the vicinity of the discharge end of the first wrap (hereinafter, referred to as the "central portion of the wrap") is defined as an inverse number of the second value. The height of the first wrap 323 is formed to gradually decrease from the suction end to the discharge end, so that the wrap height in the central portion of the wrap is formed differently along an advancing direction of the wrap. Therefore, ideally, in order to accurately calculate the wrap height in the corresponding section (the central portion of the wrap), as aforementioned, the average height of the wrap may be obtained for substitution. However, as a difference in wrap height is extremely small, the average height of the wrap may be ignored and generalized to the wrap height. The radius of curvature of the wrap may also be generalized and substituted. For reference, the radius of curvature of the wrap is in the range of approximately 10 to 20 mm.

That is, if this is expressed by Equation (1), $$A=1/((h/t)\times R)$$

Here, an arbitrary value 1000 mm may be multiplied.

However, the height and thickness of the wrap, as aforementioned, may be defined by the average wrap height, the average wrap thickness, and the average radios of curvature of a predetermined section. In some cases, however, it may also be defined by a wrap height, a wrap thickness, and a wrap radius of curvature of a specific point with respect to an advancing direction of the wrap. However, in general, it is advantageous to define each element based on a predetermined section in terms of machining.

For example, in this embodiment, if a section showing the greatest amount of deformation of the wrap is 0 to 60° (where 0° is the discharge end), the rigidity coefficient may be calculated using the average wrap height and the average wrap thickness between 0 and 60° as the corresponding section, more particularly, between 0 and 45°.

The limit range for the rigidity coefficient A in the section may be about 0.005 or more. That is, when the rigidity coefficient is obtained by referring to the above Equation 1, (h/t) does not exceed about 10. When a value obtained by dividing the average wrap height by the average wrap thickness is 10 or more, the wrap height is too high compared to the wrap thickness. Accordingly, the wrap rigidity becomes very weak and the wrap is broken. Therefore, (h/t) may be formed to be 10 or less. The lowest value does not have to be limited because the rigidity increases more when the wrap thickness is greater than the wrap height.

In addition, the average radius of curvature of the wrap is about 10 to 20 mm. The wrap rigidity increases when the radius of curvature of the wrap is as small as possible. Thus, even in this case, there is no need to limit the case where the radius of the wrap curvature is small. Therefore, when the average radius of curvature of the wrap is set to about 20 mm and substituted info the above Equation (1), the rigidity coefficient A is 1/((10)×20). Therefore, the rigidity coefficient is 0.005 mm, and when the value is multiplied by an arbitrary value 1000 mm, the rigidity coefficient is 5. As this corresponds to the minimum rigidity coeffeicient value, the limit range of the rigidity coefficient for the discharge end of the wrap may be 5 or more.

Figure 15:
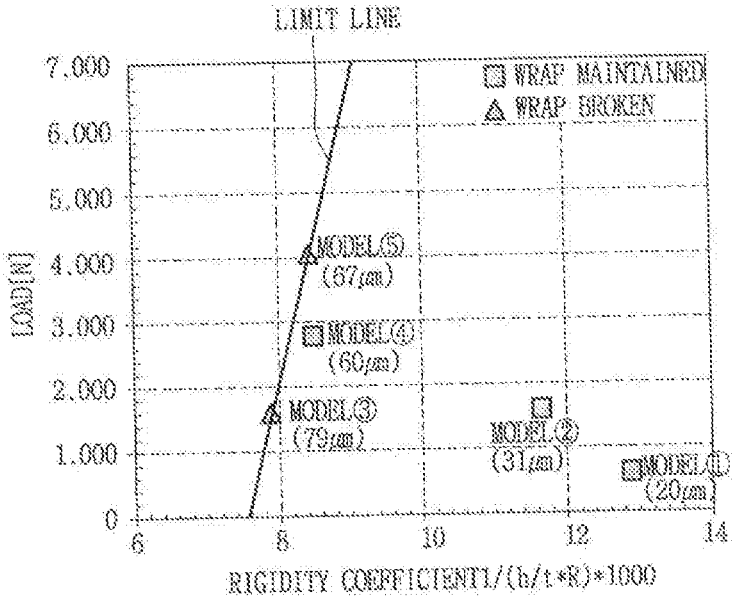
FIG. 15 is a graph showing an analysis of wrap deformation amounts according to various configurations and operation speeds of a first wrap in the scroll compressor according to an embodiment.

Based on the limit range of the rigidity coefficient, a proper wrap shape of the discharge end may be decided. FIG. 15 is a graph showing an analysis of a wrap deformation amount according to various standards and operation speeds for the first wrap.

As illustrated in the drawing, the amount of wrap deformation is about 20 μm in the case of a model ①, 31 μm in the case of a model ②, about 79 μm in the case of a model ③, about 60 μm in the case of a model ④, and about 67 μm in the case of a model ⑤.

In the models ③ and ⑤ where the wrap deformation amount is relatively large among these models, the vicinity of the discharge end of the wrap is broken, while in the remaining models ①, ② and ④, the vicinity of the discharge end of the wrap is maintained without being damaged. Therefore, a line connecting the model ③ and the model ⑤ may be defined as a limit line, and the wrap rigidity for limiting the amount of wrap deformation to belong to the right side based on the limit line may be defined.

Referring to FIG. 15, a slope of the limit line may be in the range of about 0.0001 to 0.0003, and an offset amount in the range of about 7.0000 to 8.0000. Accordingly, the rigidity coefficient may be formed to be larger than at least [(0.0001 to 0.0003)×wrap load (N) by gas force+(7,000 to 8,0000)]. More precisely, the rigidity coefficient may be formed to be larger than [0.0002×wrap load (N) by gas force+7.5202].

In this embodiment, the limit range of the rigidity coefficient for optimizing the wrap rigidity of the vicinity of the discharge end of the first wrap is described, but this may also be applied to other sections of the first wrap (or the second wrap). However, as the limit line may be differently interpreted in a different section of the first wrap (or the second wrap), the limit range of the rigidity coefficient in each section may be defined according to a newly calculated limit line range.

Figure 16:
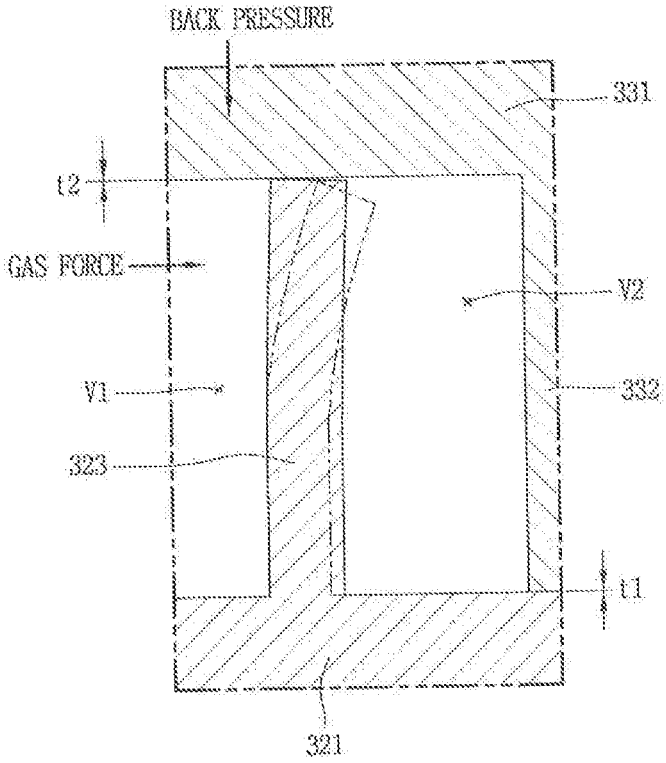
FIG. 16 is a sectional view illustrating a deformation amount of a discharge end of a wrap having a rigidity coefficient limit range of a wrap according to an embodiment, in comparison with the related art.

As described above, by optimally forming the wrap rigidity of the portion adjacent to the discharge end of the first wrap (or the second wrap) as described above, the wrap deformation of the discharge end near the central portion receiving relatively high back pressure and gas force (centrifugal force), as illustrated in FIG. 16, may be minimized as compared to the related art (indicated with a dotted line), and accordingly, the first wrap 323 may be prevented from excessively adhering to the second disk portion 331 of the second scroll 33 that the first wrap 323 faces, which may result in reducing frictional loss or abrasion between the first wrap 323 and the second disk portion 331 (or between the second wrap and the first disk portion), thereby enhancing efficiency of the compressor.

By optimally forming the wrap rigidity of the portion adjacent to the discharge and of the first wrap 323 (or the second wrap), the discharge end near the central portion of the first wrap 323 (or the second wrap) may be prevented from being deformed due to being bent outward in a radial direction. Accordingly, leakage of refrigerant between the compression chambers V1 and V2 may be prevented so as to enhance the efficiency of the compressor and simultaneously a breakage of the discharge end of the wrap may be prevented so as to enhance reliability of the compressor.

Even when the discharge end of the first wrap 323 is located far away from the center of the first scroll 32 because the rotational shaft 50 is inserted through the central portion of the first scroll 32, the wrap rigidity at the portion adjacent to the discharge end may be optimized so as to prevent frictional loss or abrasion between the first wrap 323 (or the second wrap) and the second disk portion 331 facing the first wrap 323 or deformation or breakage of the fixed wrap, thereby enhancing efficiency and reliability of the compressor.

Embodiments disclosed herein provide a scroll compressor, capable of optimizing a height or rigidity of a discharge end of the wrap, so as to prevent a frictional loss or abrasion from being caused due to an excessive adhesion of the discharge end of the wrap to a disk portion or disk of an opposing scroll. Embodiments disclosed herein further provide a scroll compressor, capable of optimizing a height of a discharge end of a wrap or a rigidity of the wrap, so as to prevent the discharge end of the wrap from being excessively deformed and broken. Embodiments disclosed herein also provide a scroll compressor, capable of optimizing a height of a discharge end of a fixed wrap even when a rotational shaft is inserted through a fixed scroll to overlap a compression chamber in a radial direction, so as to prevent the discharge end of the fixed wrap from being excessively deformed or broken and accordingly increase efficiency and reliability of the compressor.

Embodiments disclosed herein provide a scroll compressor in which an end surface of a wrap formed on one of two members, which are slidable with respect to each other, is formed to have at least two inclination angles. The inclination angles may be formed such that a portion adjacent to a discharge side has a largest inclination angle.

Embodiments disclosed herein provide a scroll compressor that may include a first wrap, and a second wrap engaged with the first wrap and coupled to be eccentric to a center of rotation of a rotational shaft to form a compression chamber, moving toward a central portion, together with the first wrap while performing an orbiting motion with respect to the first wrap. A height of at least one of the first wrap or the second wrap may be formed to have at least two inclination machining amounts which decrease toward the central portion, and the inclination machining amount of the central portion may be larger than the inclination machining amount of an edge portion or edge.

When a portion near the central portion of the first wrap or the second wrap is referred to as a discharge end, and the discharge end is 0° based on a rotational angle of the rotational shaft, a portion formed by an inclination machining amount of the portion adjacent to the central portion may be formed to include at least a part or portion of a range of 0 to 60° based on the rotational angle of the rotational shaft.

The central portion of the second wrap may be provided with a rotational shaft coupling portion to which the rotational shaft may be coupled in a manner of overlapping the second wrap in a radial direction. A concave portion at which a thickness of the wrap is decreased may be formed on an outer surface of the rotational shaft coupling portion, and a protruding portion or protrusion engaged with the concave portion may be formed on the discharge end of the first wrap. The portion formed by the inclination machining amount near the central portion may include the protruding portion.

When a first value is obtained by dividing an average wrap height in a specific section of the at least one of the first wrap or the second wrap by an average wrap thickness, a second value is obtained by multiplying the first value and an average radius of curvature of the wrap together, and a value defined as an inverse value of the second value is a rigidity coefficient, a limit range of the rigidity coefficient of the wrap in the specific section may be equal to or larger than a limit line range defined by [(0.0001 to 0.0003)×wrap load (N)+(7.0000 to 8.0000)]. The limit line range may be a value defined by [0.002×wrap load (N)+7,5202].

When a portion near the central portion of the first wrap is referred to as a discharge end and the discharge end is 0° based on a rotational angle of the rotational shaft, the specific section may be in the range of 0 to 45° based on the rotational angle of the rotational shaft.

Embodiments disclosed herein further provide a scroll compressor that may include a first scroll provided with a first disk portion or disk having a bearing hole formed through a central portion thereof such that a rotational shaft may be inserted therethrough, and a discharge port formed near the bearing hole, and a first wrap that protrudes from one side surface of the first disk portion, and a second scroll provided with a second disk portion or disk having a rotational shaft coupling portion formed through a central portion thereof such that the rotational shaft inserted through the bearing hole of the first scroll may be eccentrically coupled thereto, and a second wrap that protrudes from one side surface of the second disk portion and engaged with the first wrap to form a compression chamber together. At least one of an end surface of the first wrap facing the second disk portion or an end surface of the second wrap facing the first disk portion may be formed to have a plurality of inclined surfaces such that a height of the wrap is lowered or decreases toward the central portion. A second inclined surface adjacent to the discharge port among the plurality of inclined surfaces may be formed to have an inclination angle larger than an inclination angle of a first inclined surface farther from the discharge port.

The second inclined surface may be formed over the entire end surface along an advancing direction of the first wrap or the second wrap. The second inclined surface may be formed on a part or portion of the end surface along an advancing direction of the first wrap or the second wrap.

The second inclined surface may be formed on an edge receiving a gas force, of both edges forming the end surface of the first wrap or the second wrap. The second inclined surface may have at least one inclination angle. The second inclined surface may have a plurality of inclination angles, and the plurality of inclination angles may be formed in a manner that an inclination angle more adjacent to the discharge end of the first wrap or the second wrap is larger.

A concave portion at which a thickness of the wrap is decreased may be formed on an outer surface of the rotational shaft coupling portion, and the discharge end of the first wrap may be provided with a protruding portion or protrusion engaged with the concave portion. The second inclined surface may be formed to include the protruding portion.

When a first value is obtained by dividing an average wrap height in a specific section of the at least one of the first wrap or the second wrap by an average wrap thickness, a second value is obtained by multiplying the first value and an average radius of curvature of the wrap together, and a value defined as an inverse value of the second value is a rigidity coefficient, a limit range of the rigidity coefficient of the wrap in the specific section may be equal to or larger than a limit line range defined by [(0.0001 to 0.0003)×wrap load (N)+(7,0000 to 8.0000)]. The limit line range may be a value defined by [0,0002×wrap load (N)+17.5202].

Embodiments disclosed herein also provide a scroll compressor, including a casing having an inner space in which oil may be stored, a drive motor provided in the inner space of the casing, a rotational shaft coupled to the drive motor, a frame provided below the drive motor, a first scroll disposed beneath the frame and provided with a first wrap formed on one side thereof, a bearing hole formed through a central portion thereof such that the rotational shaft may be inserted therethrough, and a discharge port formed around the bearing hole, and a second scroll engaged with the first wrap, having the rotational shaft eccentrically coupled thereto in a manner of overlapping the second wrap in a radial direction, the second scroll forming a compression chamber together with the first scroll while performing an orbiting motion with respect to the first scroll. At least one of an end surface of the first wrap protruding downward toward the second scroll or an end surface of the second wrap protruding upward toward the second scroll may be formed to have a plurality of inclined surfaces so that a height of the wrap is lowered or decreases toward the central portion. A second inclined surface adjacent to the discharge port among the plurality of inclined surfaces may be formed to have an inclination angle larger than an inclination angle of a first inclined surface farther from the discharge port.

When the discharge end of the first wrap or the second wrap is 0° based on a rotational angle of the rotational shaft, a portion formed by an inclination machining amount near the central portion may be formed to include at least a part or portion of a range of 0 to 60° based on the rotational angle of the rotational shaft. When the maximum height of the first wrap or the second wrap is H1, the inclination machining amount of the first inclined surface is H2, the inclination machining amount of the second inclined surface is H3, H2<[(0.001~0.002)×H1]mm, and H3>[(0.01~0.03)×H1] mm.

The central portion of the second wrap may be provided with a rotational shaft coupling portion to which the rotational shaft may be coupled in a manner of overlapping the second wrap in a radial direction. A concave portion at which a thickness of the wrap is decreased or decreases may be formed on an outer surface of the rotational shaft coupling portion, and a protruding portion or protrusion engaged with the concave portion may be formed on the discharge end of the first wrap. The second inclined surface may be formed to include the protruding portion.

When it is assumed that a first value is obtained by dividing an average wrap height in a specific section of the at least one of the first wrap or the second wrap by an average wrap thickness, a second value is obtained by multiplying the first value and an average radius of curvature of the wrap together, and a value defined as an inverse value of the second value is a rigidity coefficient, a limit range of the rigidity coefficient of the wrap in the specific section may be equal to or larger than a limit line range defined by [(0.0001 to 0.0003)×wrap load (N)+(7.0000 to 8.0000)]. The limit line range may be a value defined by [0.0002×wrap load (N)+7.5202].

As described above, by optimally forming a wrap height or a wrap rigidity of a portion adjacent to a discharge end of a fixed wrap or an orbiting wrap, a wrap deformation of the discharge end near the central portion receiving relatively high back pressure and gas force may be minimized, so as to prevent an excessive contact of the wrap with the scroll facing the wrap, and accordingly, reduce a frictional loss or abrasion between the wrap and the scroll, thereby enhancing efficiency of the compressor. By optimally forming the wrap height or wrap rigidity of the portion adjacent to the discharge end of the fixed wrap or the orbiting wrap, the discharge end near the central portion of the fixed wrap or the orbiting wrap may be prevented from being deformed due to being bent outward in a radial direction. Accordingly, a leakage of refrigerant from a compression chamber may be prevented so as to enhance efficiency of the compressor and simultaneously a breakage of the discharge end of the wrap may be prevented so as to enhance reliability of the compressor.

Even when the discharge end of the fixed wrap is located far away from the center of the fixed wrap because the rotational shaft is inserted through the central portion of the first scroll, the wrap height at the portion adjacent to the discharge end may be optimized so as to prevent frictional loss or abrasion between the fixed wrap and the scroll or deformation or breakage of the fixed wrap, thereby enhancing efficiency and reliability of the compressor.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, if should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a first wrap; and a second wrap engaged with the first wrap and coupled to be eccentric with respect to a center of rotation of a rotational shaft to form a compression chamber, while moving toward a central portion, together with the first wrap while performing an orbiting motion with respect to the first wrap, wherein a height of an end surface of at least one of the first wrap or the second wrap is formed to have at least two inclination machining amounts which gradually decrease toward the :central portion, and wherein an inclination machining amount of the central portion is larger than an inclination machining amount of an edge portion.

2. The compressor of claim 1, wherein a portion formed by the inclination machining amount near the central portion is formed to include at least a portion of a range of 0 to 60° based on a rotational angle of the rotational shaft, when a portion near the central portion of the first wrap or the second wrap is referred to as a discharge end and the discharge end is 0° based on the rotational angle of the rotational shaft.

3. The compressor of claim 2, wherein the central portion of the second wrap is provided with a rotational shaft coupling portion to which the rotational shaft is coupled in a manner of overlapping the second wrap in a radial direction, wherein concave portion at which a thickness of the wrap decreases is formed on an outer surface of the rotational shaft coupling portion, and a protruding portion engaged with the concave portion is formed on the discharge end of the first wrap, and wherein the portion formed by the inclination machining amount near the central portion includes the protruding portion.

4. The compressor of claim 1, wherein when a first value is obtained by dividing an average wrap height in a specific section of the at least one of the first wrap or the second wrap by an average wrap thickness, a second value is obtained by multiplying the first value and an average radius of curvature of the wraps together, and a value defined as an inverse value of the second value is a rigidity coefficient, a limit range of the rigidity coefficient of the wrap in the specific section is equal to or larger than a limit line range defined by [(0.0001 to 0.0003)×wrap load (N)+(7.0000 to 9.0000)].

5. The compressor of claim 4, wherein the limit line range is a value defined by [0.0002×wrap load (N)+7,5202].

6. The compressor of claim 4, wherein the specific section is in the range of 0 to 45° based on the rotational angle of the rotational shaft when a portion near the central portion of the first wrap is referred to as a discharge end and the discharge end is 0° based on a rotational angle of the rotational shaft.

7. A scroll compressor, comprising:

a first scroll provided with a first disk having a bearing hole formed through a central portion thereof such that a rotational shaft is inserted therethrough, and a discharge port formed near the beating hole, and a first wrap that protrudes from one side surface of the first disk; and a second scroll provided with a second disk having a rotational shaft coupling portion formed through a central portion thereof such that the rotational shaft inserted through the bearing hole of the first scroll is eccentrically coupled thereto, and a second wrap that protrudes from one side surface of the second disk and is engaged with the first wrap to form a compression chamber together, wherein at least one of an end surface of the first wrap facing the second disk or an end surface of the second wrap facing the first disk is formed to have a plurality of inclined surfaces such that a height of the wrap gradually decreases toward the central portion of the second scroll, and wherein a second inclined surface adjacent to the discharge port among the plurality of inclined surfaces is formed to have an inclination angle larger than an inclination angle of a first inclined surface farther from the discharge port.

8. The compressor of claim 7, wherein the second inclined surface is formed over the entire end surface along an advancing direction of the first wrap or the second wrap.

9. The compressor of claim 7, wherein the second inclined surface is formed on a portion of the end surface along an advancing direction of the first wrap or the second wrap.

10. The compressor of claim 9, wherein the second inclined surface is formed on an edge, receiving a gas force, of both edges forming the end surface of the first wrap or the second wrap.

11. The compressor of claim 7, wherein the second inclined surface has a plurality of inclination angles, and the plurality of inclination angles is formed in a manner that an inclination angle more adjacent to the discharge end of the first wrap or the second wrap is larger.

12. The compressor of claim 7, wherein a concave portion at which a thickness of the wrap decreases is formed on an outer surface of the rotational shaft coupling portion, and the discharge end of the first wrap is provided with a protruding portion engaged with the concave portion, and wherein the second inclined surface is formed to include the protruding portion.

13. The compressor of claim 7, wherein when a first value is obtained by dividing an average wrap height in a specific section of the at least one of the first wrap or the second wrap by an average wrap thickness, a second value is obtained by multiplying the first value and an average radius of curvature of the wrap together, and a value defined as an inverse value of the second value is a rigidity coefficient, a limit range of the rigidity coefficient of the wrap in the specific section is equal to or larger than a limit range of a limit line defined by [(0.0001 to 0.0003)×wrap load (N)+(7.0000 to 8.0000)].

14. The compressor of claim 13, wherein the limit line range is a value defined by [0.0002×wrap load (N)+7.5202].

15. A scroll compressor, comprising:

a casing having an inner space in which oil is stored;

a drive motor provided in the inner space of the casing;

a rotational shaft coupled to the drive motor;

a frame provided below the drive motor;

a first scroll disposed beneath the frame and provided with a first wrap formed on one side thereof, a hearing hole formed through a central portion thereof such that the rotational shaft is inserted therethrough, and a discharge pod formed around the bearing hole; and a second scroll engaged with the first wrap, having the rotational shaft eccentrically coupled thereto in a manner of overlapping the second wrap in a radial direction, the second scroll forming a compression chamber together with the first scroll while performing an orbiting motion with respect to the first scroll, wherein at least one of an end surface of the first wrap protruding downward toward the second scroll or an end surface of the second wrap protruding upward toward the second scroll is formed to have a plurality of inclined surfaces so that a height of the wrap gradually decreases toward the central portion, and wherein a second inclined surface adjacent to the discharge port among the plurality of inclined surfaces is formed to have an inclination angle larger than an inclination angle of a first inclined surface farther from the discharge port.

16. The compressor of claim 15, wherein a portion formed by an inclination machining amount near the central portion is formed to include at least a portion of a range of 0 to 60° based on the rotational angle of the rotational shaft, when the discharge end of the first wrap or the second wrap is 0° based on a rotational angle of the rotational shaft.

17. The compressor of claim 16, wherein when the maximum height of the first wrap or the second wrap is H1, the inclination machining amount of the first inclined surface is H2, the inclination machining amount of the second inclined surface is, H3, H2 <[(0.001~0.002)×H1]mm, and H3>[(0.01~0.03)×H1]mm.

18. The compressor of claim 15, wherein the central portion of the second wrap is provided with a rotational shall coupling portion to which the rotational shall is coupled in a manner of overlapping the second wrap in a radial direction, wherein a concave portion at which a thickness of the wrap is decreased is formed on an outer surface of the rotational shaft coupling portion, and a protruding portion engaged with the concave portion is formed on the discharge end of the fast wrap, and wherein the second inclined surface is formed to include the protruding portion.

19. The compressor of claim 15, wherein when a first value is chained by dividing an average wrap height in a specific section of the at least one of the first wrap or the second wrap by an average wrap thickness, a second value is obtained by multiplying the first value and an average radius of curvature of the wraps together, and a value defined as an inverse value of the second value is a rigidity coefficient, a limit range of the rigidity coefficient of the wrap in the specific section is equal to or larger than a limit range of a limit line defined by [(0.0001 to 0.0003)×wrap load (N)+(7.0000 to 8.0000)].

20. The compressor of claim 19, wherein the limit range of the limit line is a value defined by [0.0002×wrap load (N)+7.5202].

* * * * *